US010712009B2

(12) United States Patent
Baumann et al.

(10) Patent No.: US 10,712,009 B2
(45) Date of Patent: Jul. 14, 2020

(54) BURNER HEAD OF A BURNER AND GAS TURBINE HAVING A BURNER OF THIS TYPE

(71) Applicant: Duerr Systems AG, Bietigheim-Bissingen (DE)

(72) Inventors: Thomas Baumann, Oberhausen-Rheinhausen (DE); Axel Widenhorn, Stuttgart (DE)

(73) Assignee: Duerr Systems AG, Bietigheim-Bissinger (DE)

( * ) Notice: Subject to any disclaimer, the term of this patent is extended or adjusted under 35 U.S.C. 154(b) by 587 days.

(21) Appl. No.: 15/470,725

(22) Filed: Mar. 27, 2017

(65) Prior Publication Data

US 2017/0198914 A1 Jul. 13, 2017

Related U.S. Application Data

(63) Continuation of application No. PCT/EP2015/001864, filed on Sep. 19, 2015.

(30) Foreign Application Priority Data

Sep. 25, 2014 (WO) ..... PCT/EP2014/002604
Mar. 27, 2015 (DE) ..... 10 2015 003 920

(51) Int. Cl.
*F23R 3/36* (2006.01)
*F23R 3/28* (2006.01)
(Continued)

(52) U.S. Cl.
CPC ..... *F23R 3/286* (2013.01); *F23D 14/62* (2013.01); *F23R 3/28* (2013.01); *F23R 3/283* (2013.01);
(Continued)

(58) Field of Classification Search
CPC ..... F23R 3/343; F23R 3/286; F23D 14/62
See application file for complete search history.

(56) References Cited

U.S. PATENT DOCUMENTS 4,100,733 A 7/1978 Striebel et al.
4,845,952 A 7/1989 Beebe
(Continued)

FOREIGN PATENT DOCUMENTS

DE 10352653 A1 7/2004
EP 1791246 A2 5/2007
(Continued)

OTHER PUBLICATIONS

International Search Report of the international searching authority dated Dec. 7, 2015 in international patent application PCT/EP2015/001864 on which this application is based.
(Continued)

*Primary Examiner* — Gerald L Sung
(74) *Attorney, Agent, or Firm* — Walter Ottesen, P.A.

(57) ABSTRACT

A burner head for a burner defines a burner longitudinal axis along which the burner extends. The burner head includes a base body and at least one oxidant duct defining a duct longitudinal axis. The oxidant duct is arranged in the base body at a radial spacing to the burner longitudinal axis. A fuel duct body is inserted into the oxidant duct and at least one fuel nozzle is configured on the fuel duct body so as to open into the oxidant duct.

11 Claims, 12 Drawing Sheets

(51) Int. Cl.
*F23R 3/34* (2006.01)
*F23D 14/62* (2006.01)

(52) U.S. Cl.
CPC .... *F23R 3/343* (2013.01); *F23D 2900/00008* (2013.01); *F23R 2900/00002* (2013.01)

(56) References Cited

U.S. PATENT DOCUMENTS 5,361,586 A * 11/1994 McWhirter ..... F23D 14/02 60/737
5,647,215 A * 7/1997 Sharifi ..... F23D 17/002 60/737
6,755,024 B1 6/2004 Mao et al.
6,938,733 B2 9/2005 Eilinger
2009/0183511 A1* 7/2009 Dinu ..... F23R 3/14 60/737
2010/0323309 A1* 12/2010 Barkowski ..... F23R 3/286 431/8
2011/0057056 A1 3/2011 Ziminsky et al.
2012/0285172 A1* 11/2012 Poyyapakkam ..... F23R 3/14 60/737
2012/0297785 A1* 11/2012 Melton ..... F23R 3/02 60/772
2012/0297786 A1* 11/2012 Crawley ..... F23R 3/02 60/772
2013/0036743 A1 2/2013 Khan et al.
2013/0133329 A1* 5/2013 Wang ..... F23R 3/286 60/737
2013/0219897 A1* 8/2013 Nakamura ..... F02C 7/222 60/737
2014/0311150 A1* 10/2014 Pinson ..... F23R 3/286 60/737
2014/0366553 A1* 12/2014 Beck ..... F23R 3/286 60/779
2015/0089954 A1 4/2015 Widenhorn et al.
2017/0146242 A1* 5/2017 Meadows ..... F02C 7/222

FOREIGN PATENT DOCUMENTS

EP 2597374 A1 5/2013
WO 9211679 A1 7/1992

OTHER PUBLICATIONS

Translation of the Written Opinion of the international searching authority dated Mar. 2, 2017 in international patent application PCT/EP2015/001864 on which this application is based.

* cited by examiner

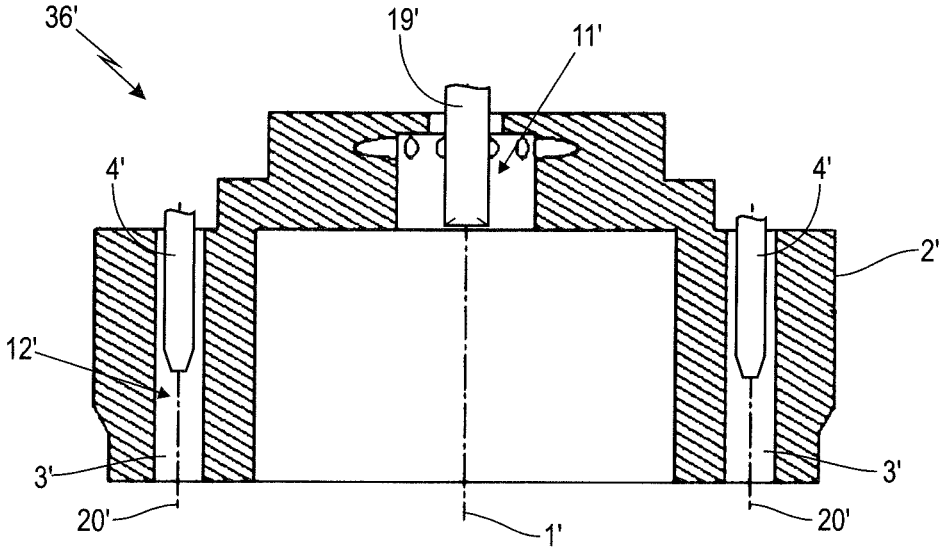
*Fig. 3* *prior art*
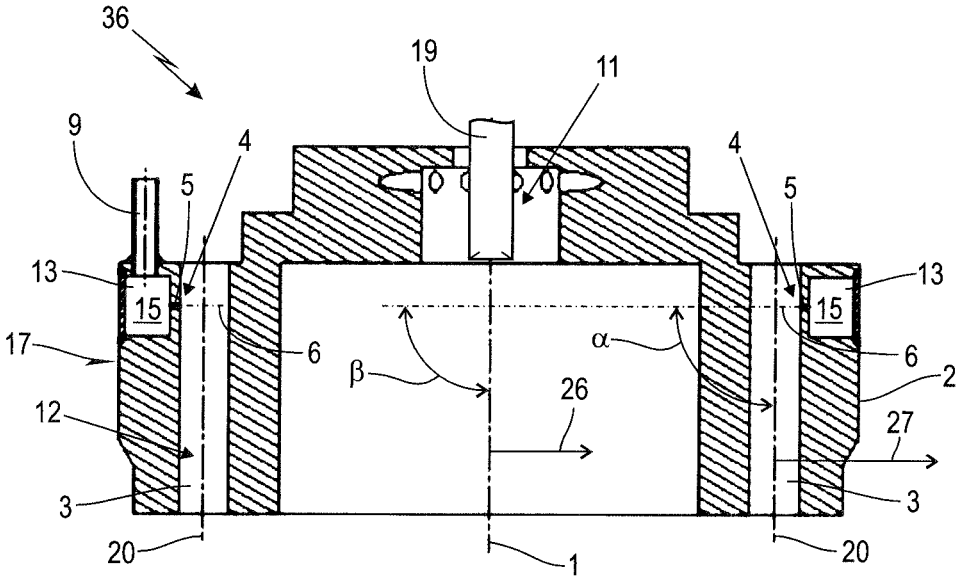
*Fig. 4*

BURNER HEAD OF A BURNER AND GAS TURBINE HAVING A BURNER OF THIS TYPE

CROSS REFERENCE TO RELATED APPLICATIONS

This application is a continuation application of international patent application PCT/EP2015/001864, filed Sep. 19, 2015, designating the United States and claiming priority from German application 10 2015 003 920.2, filed Mar. 27, 2015, and international patent application PCT/EP2014/002604, filed Sep. 25, 2014; the entire content of the aforementioned applications is incorporated herein by reference.

FIELD OF THE INVENTION

The invention relates to a burner head of a burner and to a gas turbine having the burner.

BACKGROUND OF THE INVENTION

For the decentralized supply of electrical, thermal and/or mechanical energy to businesses, for example, use is increasingly being made of cogeneration systems which are operated with a combustion machine in particular in the form of a micro gas turbine. Such micro gas turbines are gas turbines of the lower power class, that is, up to approximately 500 kW rated power. Cogeneration systems of this type comprise, in known embodiments, not only the combustion machine itself but also a power converter which can be driven by the combustion machine, in particular in the form of an electrical generator, and a waste-heat device for the utilization of the waste heat contained in the exhaust gas of the combustion machine.

The gas turbines have, between a compressor and a turbine, a burner in which fuel is oxidized or burned with an oxidant, generally with air. The required mixing of fuel and oxidant takes place in a burner head. This burner head is typically attached to a burner flange via which the fuel supply lines are also led. Downstream of the burner head there is positioned a combustion chamber. The burner head extends along a burner longitudinal axis and normally comprises multiple oxidant ducts arranged with a radial spacing to the burner longitudinal axis in a main body. Into the oxidant ducts there issues in each case one fuel nozzle, which according to the prior art is in the form of a nozzle lance. Here, in each case one nozzle lance is situated preferably coaxially in a respective oxidant duct. The nozzle lances are normally held on the burner flange, where they are oriented and mounted in an axial direction by means of a structural shoulder. The fixing of the burner nozzles is generally realized by means of plates which are screwed to the burner flange. Here, the nozzle lances are inserted into the combustion chamber via the individual oxidant ducts, which are situated in the burner flange and which are in the form of passage bores. The fuel supply is realized via individual hoses which are fed via an upstream external distributor ring or else have a fuel supply duct in the burner flange. In systems that have hitherto been realized, the fuel nozzles are produced from solid material.

Here, a high level of outlay in terms of manufacturing, assembly and disassembly are involved, along with increased cost outlay owing to the high number of individual components. In particular, the manufacture of the nozzle lances is expensive, because thin bores (1 to 4 mm diameter) over a length of several centimeters are required for conducting the fuel. Further disadvantages that have been identified are a high risk of leakage owing to individual seals with often small sealing surfaces for structural space reasons, a susceptibility to failure owing to the installation complexity, and the requirement for an external fuel distributor ring and individual holse and/or pipe connections from the fuel distributor ring to the fuel nozzles.

SUMMARY OF THE INVENTION

It is an object of the invention to provide a burner head such that, with a simplified construction, increased reliability is achieved.

It is a further object of the invention to provide a turbine, in particular a gas turbine or a micro gas turbine having an improved burner.

In an advantageous embodiment of the invention, it is provided that, in the main body of the burner head, there is formed at least one supply duct for the supply of fuel to the at least one fuel nozzle. In particular, a multiplicity of oxidant ducts is provided so as to be arranged around the burner longitudinal axis in the main body, the oxidant ducts having at least in each case one fuel nozzle which opens into a respective oxidant duct, wherein the fuel nozzles are at least partially, and in particular all, connected to the at least one supply duct for the supply of fuel. Owing to the integration of the supply duct into the main body of the burner head, it is possible to dispense with the complex arrangement of hoses, pipelines or the like that is customary and required according to the prior art. The implementation of the supply duct in the main body of the burner head is simple in terms of construction, can be produced inexpensively, and is furthermore reliable in terms of function.

According to the invention, a fuel duct body is led into the oxidant duct, wherein the at least one fuel nozzle is formed on the fuel duct body and is in particular arranged at least approximately on the duct longitudinal axis. Here, "led into the oxidant duct" is to be understood in particular to mean that the fuel duct body projects into an opening cross section of the oxidant duct, at least partially extends through or leads through the opening cross section or divides the opening cross section into partial cross sections, and/or that the fuel duct body is arranged and/or provided in the oxidant duct. Here, too, a simple structural form is realized which dispenses with the nozzle lances that are customary according to the prior art. This structural form leads to positioning of the fuel nozzle on the duct longitudinal axis or at least sufficiently close to the latter. In any case, an at least substantially central injection of fuel can be achieved, which can promote a clean mixture formation. In a preferred variant, the fuel duct body has a supply bore for supplying fuel from the supply duct to a nozzle bore which is provided in the fuel duct body and which is connected to the supply bore. It may however be provided that the nozzle bore is formed so as to be supplied with fuel directly from the supply duct.

Here, the fuel duct body may be formed in one piece with, or formed so as to be connected to, the main body of the burner head. In a preferred variant, the fuel duct body may be formed or configured as a slide-in and/or press-in component for application in the oxidant duct. In a preferred embodiment as an application body, the fuel duct body does not have a supply bore before being positioned in the oxidant duct. This supply bore is generated by drilling machining, performed from the side of the supply duct, only after the application of the fuel duct body in the oxidant duct. Here, drilling machining is to be understood in particular to mean any method for producing or providing a bore-like or duct-like recess in a solid material. In particular, use may be made of an erosion and/or laser machining process. If the nozzle bore has already been formed in the fuel duct body prior to the application, this nozzle bore is drilled into by means of the drilling machining process such that the nozzle bore can be supplied with fuel from the supply duct. Alternatively, it may also be provided that the nozzle bore is produced for the first time together with or after the drilling machining for the supply bore.

In a further aspect, the fuel duct bodies act as bluff bodies in the air supply of a burner, in particular of a FLOX® burner (FLOX® stands here for the flameless oxidation of a fuel). This bluff body causes a vortex street to be formed downstream. The fuel is introduced into the oxidant duct via the duct provided fuel duct body, in particular the supply and/or nozzle bore, and mixes with the oxidant flowing in this oxidant duct. The vortex street gives rise here to advantageously intensified mixing of fuel with the oxidant owing to the additional vortices. The characteristic periodic separations of vortex wakes downstream of the fuel duct body additionally advantageously intensify the turbulence of the flow. In this way, the mixing effect of the flameless oxidation, which is based on high turbulence, is intensified and thus further improved.

The vortex intensity and frequency can be influenced by means of the dimensions and/or shape of the introduced fuel duct body. Depending on the flow conditions prevailing during operation, it may be advantageous here to use fuel duct bodies with circular, oval, droplet-shaped, polygonal, trapezoidal, kite-shaped or similar cross sections along a direction transverse with respect to the duct longitudinal axis (with or without rounded edges).

In preferred embodiments, the fuel duct body has side surfaces which are symmetrical in the flow direction of the oxidant, wherein the symmetry may preferably be in the form of simple rotational, point and/or mirror symmetry. In special examples, the side surfaces may however also be of asymmetrical configuration.

In the presence of given flow conditions, not only the configuration and axial extent of the side surfaces in the flow direction but also an inflow geometry, for example inflow angle and/or inflow surface/plateau, of that part of the fuel duct body which is directed upstream, and/or an outflow geometry, for example separation angle and/or outflow geometry, of that part of the fuel duct body which is directed downstream define the formation and characteristics of the vortex street.

Through selection of a fuel duct body with a small return flow area, it is additionally possible to prevent a reaction close to the body, because the fuel flows off the bluff body and reacts with the oxidant for the first time downstream thereof.

The fuel duct body is preferably arranged in the oxidant duct such that a neutral filament of the oxidant flow, in particular a duct longitudinal axis of the oxidant duct, runs through the fuel duct body. This arrangement will hereinafter also be referred to as central arrangement of the fuel duct body.

Under certain circumstances or operating states, the vortex street may introduce instabilities into the combustion chamber, or add to or intensify such instabilities. These may influence the combustion characteristics in the burner. A further possibility for influencing the effects of the bluff body consists in arranging the fuel duct body asymmetrically in the oxidant duct and/or configuring the fuel duct body to be asymmetrical. Despite a reduction in the intensity of the vortex street, the turbulence of the flow is increased by means of the fuel duct body thus arranged and/or configured. In this way, an improvement in the flameless oxidation is possible even with a less pronounced vortex street.

A further possibility for influencing, in particular reducing, the periodic separation in a wake area downstream of the fuel duct body lies in the arrangement of a second bluff body or further bluff bodies downstream of the fuel duct body. Depending on requirements, the bluff bodies may in this case be configured as analogous fuel duct bodies for jointly injecting the fuel or purely as bluff bodies. They bluff bodies or fuel duct bodies in the respective oxidant duct may in this case have mutually different geometries, in particular a different cross section and/or a different symmetry of the side surfaces and/or a different topology of the side surfaces, whereby the formation of a dominant frequency in the combustion chamber is advantageously suppressed.

If via the fuel injection into the combustion chamber takes place multiple ducts, in particular oxidant ducts, it is possible by configuring the bluff bodies or fuel duct bodies with different geometries to effect the formation of vortex streets with different amplitude, frequency and/or separation. This may have the advantage that the formation of a dominant frequency in the combustion chamber is suppressed, which can increase the stability of the flameless oxidation. In this way, a stabilization of the combustion process is possible. This effect may also be effected in the case of only one oxidant duct with fuel injection in which at least two bluff bodies and/or fuel duct bodies, which differ from one another in terms of their geometry, in particular in terms of cross section and/or in terms of the symmetry of the side surfaces and/or the topology of the side surfaces, are arranged or provided in the oxidant duct.

In an advantageous embodiment, a fuel duct section and a gas duct section are formed in the fuel duct body, wherein the fuel duct section and the gas duct section open jointly into the at least one fuel nozzle. A gas, preferably an oxidation gas such as combustion air, is conveyed through the gas duct section, whereas fuel is provided through the fuel duct section. Fuel and gas enter jointly as a fuel-gas mixture into the oxidant duct through the fuel nozzle, wherein the gas fraction of this mixture promotes an atomization of the fuel.

In a preferred embodiment, the oxidant ducts and the associated fuel nozzles, in particular fuel ducts, are divided at least into a first burner stage and a second burner stage, wherein separate and mutually independent fuel feeds, in particular fuel supply ducts, are provided for the different burner stages. In particular, the burner head in this case has a central pilot stage and a main stage arranged preferably concentrically around the pilot stage, wherein the main stage is formed by the at least two different burner stages. In this way, it is possible to achieve an optimum adaptation to different load states. The central pilot stage stabilizes the combustion and ensures reliable functioning during transient regulation processes. In the pilot stage, however, only a small part of the total fuel flow is converted. By far the greatest fraction of the fuel conversion and power is realized by the two-stage main stage. Owing to the two-stage or multi-stage configuration, it is possible to realize an adaptation to changes in power demand by virtue of one or more stages of the main stage being deactivated while one or more remaining stages of the main stage operate at their optimum operating point.

The invention described in principle above and in more detail further below is preferably used in a gas turbine, which in turn is preferably part of a cogeneration system. Here, the stated advantages come fully to bear here. The burner head according to the invention may however likewise advantageously be used in other burners for example for heating installations, heating boilers, exhaust air purification plants, furnaces or the like.

In particular in the case of purification plants for the thermal or regenerative thermal oxidation of exhaust gases, exhaust air and/or wastewater containing combustible pollutants, it is possible through the use of the burner head according to the invention for a level of purification performance to be advantageously stabilized even in the presence of rapidly and/or intensely varying calorific values of the exhaust gases, exhaust air and/or wastewater and/or in the presence of rapidly and/or intensely fluctuating mass flows.

BRIEF DESCRIPTION OF THE DRAWINGS

The invention will now be described with reference to the drawings wherein:

FIG. 3 shows, in longitudinal section, a burner head in the form of a burner flange according to the prior art for a burner according to FIG. 2, with fuel nozzles in the form of nozzle lances;

FIG. 4 shows, in longitudinal section, a first embodiment of a burner head according to the invention with a ring-shaped supply duct for fuel which is formed in the main body and which is in the form of a closed ring-shaped groove formed in the circumferential surface, and with fuel ducts which lead from the supply duct to the respective oxidant duct and which form the fuel nozzles;

DESCRIPTION OF THE PREFERRED EMBODIMENTS OF THE INVENTION

Figure 1:
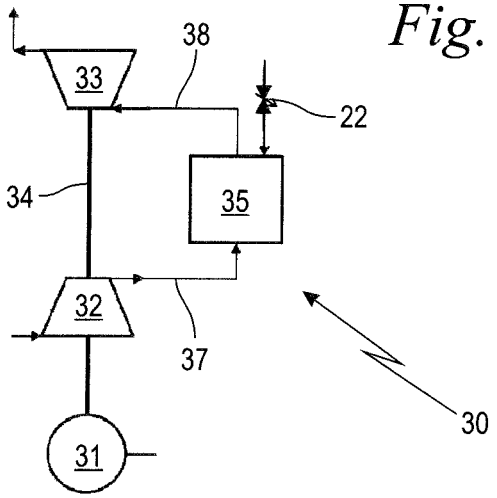
FIG. 1 shows, in a schematic block diagram, a gas turbine with a burner according to the invention.

FIG. 1 shows, in a schematic block diagram, a gas turbine 30 which is preferably used in a cogeneration system. The gas turbine 30 comprises a compressor 32, a turbine 33 and a burner 35, wherein the compressor 32 is driven by the turbine 33 by means of a shaft 34. The shaft 34 furthermore drives a schematically indicated generator 31 or some other power machine. By means of the compressor 32, air or some other oxidant is drawn in, compressed and supplied, as an oxidant flow or combustion air flow 37, to the likewise merely schematically indicated burner 35. By means of an adjustable throughflow limiting element 22, which is possibly also capable of being shut off, it is furthermore the case that fuel is supplied to the burner 35, which fuel is oxidized or burned in the burner 35 together with the oxidant flow 37. This generates a high-energy exhaust-gas flow 38, which is discharged through the turbine 33 and, in the process, is expanded, as a result of which the turbine 33, and by means thereof also the compressor 32 and the generator 31, are driven.

Depending on the configuration of the cogeneration system schematically indicated in FIG. 1, it is however also possible for additional or alternative forms of useful energy production to be used. For example, the waste heat of the exhaust-gas flow 38 may be utilized directly for heating purposes.

Figure 2:
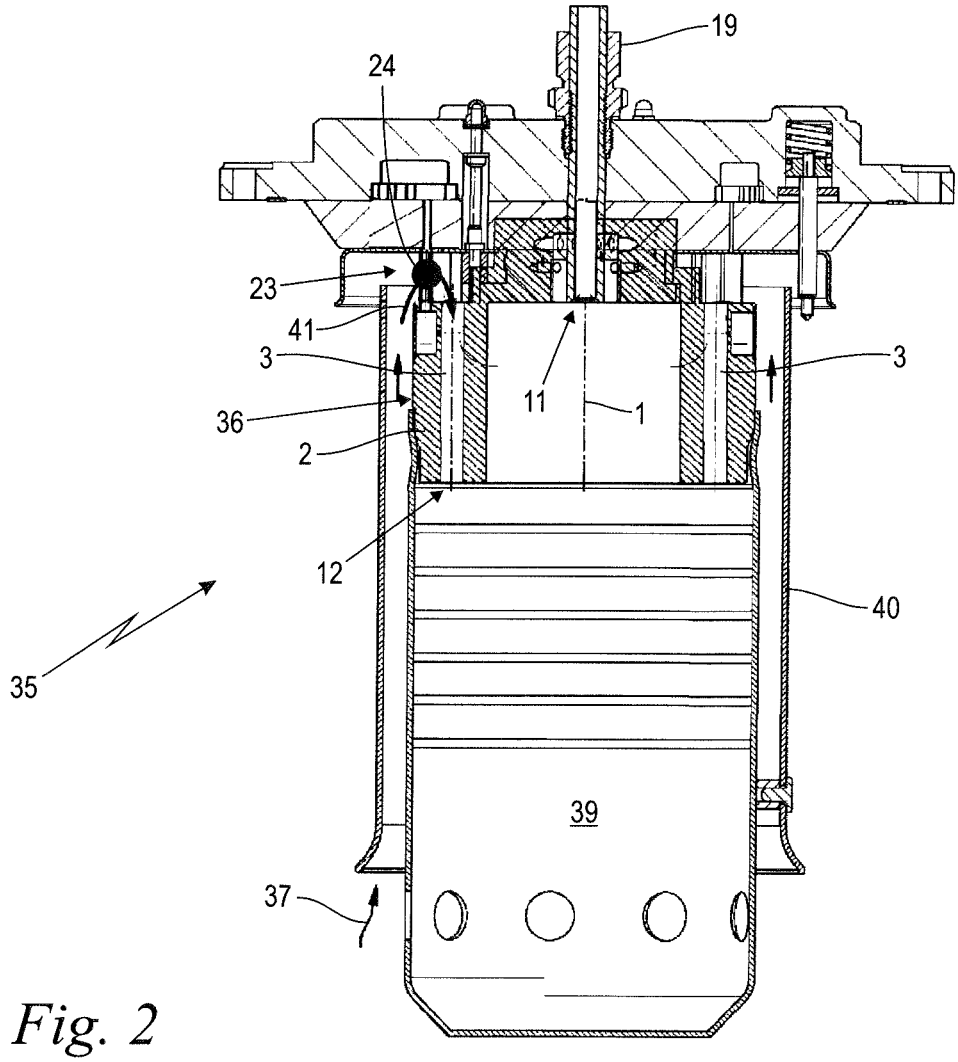
FIG. 2 shows, in longitudinal section, the burner according to the invention as per FIG. 1 with a burner head and with a downstream combustion chamber, for the purposes of illustrating the gas guidance.

FIG. 2 shows, in a longitudinal sectional illustration, an embodiment of the burner 35 according to the invention of the gas turbine 30 as per FIG. 1. The burner 35, or its burner head 36, may also be used for other purposes, for example in heating installations, heating boilers, furnace plants, in an exhaust air purification arrangement, or the like. In the embodiment shown, the burner 35 comprises at least one combustion chamber 39, at one end of which there is arranged a burner head 36. The burner head 36 extends along a burner longitudinal axis 1 or concentrically around the latter, wherein the burner longitudinal axis runs toward the combustion chamber 39 or concentrically through the latter. Multiple combustion chambers 39 may also be advantageous.

The burner head 36 comprises a main body 2 which, in this case, is preferably of unipartite form and in which there is formed at least one oxidant duct 3 arranged with a radial spacing to the burner longitudinal axis 1. In the preferred embodiment shown in FIG. 4, a multiplicity of oxidant ducts arranged concentrically around the burner longitudinal axis 1 are provided in the main body 2. The oxidant ducts 3 of the preferred example as per FIG. 4 are in this case arranged so as to be distributed with uniform angular spacings along a circumferential line around the burner longitudinal axis 1. In the example as per FIG. 4, it is furthermore provided that the oxidant ducts 3 have a uniform radial spacing to the burner longitudinal axis 1. Furthermore, in the example as per FIG. 4, the oxidant ducts 3 have a uniform, circular cross-sectional contour with approximately equal duct diameters, as can be seen most clearly in FIG. 10. It may however also be advantageous for adjacent oxidant ducts 3 to have varying angular spacings on the circumferential line around the burner longitudinal axis 1 and/or varying radial spacings to the burner longitudinal axis 1 and/or mutually different duct cross sections, in particular cross-sectional contours and/or diameters. For example, a preferred embodiment may also comprise two, three or more groups of oxidant ducts 3, which differ in group-wise fashion with regard to their angular spacing and/or their radial spacing and/or their duct cross section.

Furthermore, the main body 2 as per FIG. 4 also bears, centrally on the burner longitudinal axis 1, a pilot fuel nozzle 19, the function of which will be described in more detail further below.

In the preferred embodiment shown, the combustion chamber 39 or the outer wall thereof is surrounded by a casing 40, whereby an annular space is formed. At an end of the annular space facing away from the burner head 36, the oxidant flow or combustion air flow 37 is introduced and conducted to the opposite end of the burner head 36. There, an oxidant or combustion-air plenum 23 is formed which encircles the burner longitudinal axis 1 in ring-shaped fashion and in which the oxidant collects, is diverted correspondingly to an arrow 41, and is fed, on the side situated opposite the combustion chamber 39, into the at least one or multiple oxidant ducts 3. Upstream of the oxidant ducts 3, there may optionally be arranged a schematically indicated throughflow throttle element 24 (not shown in any more detail) for the oxidant flow 37, by means of which throughflow throttle element the throughflow rate of the oxidant can be adjusted, controlled and/or regulated as required.

In the region of the oxidant ducts 3, fuel is supplied to the oxidant flow 37, which is not shown in any more detail here but which will be described in more detail below in conjunction with FIGS. 4 to 10. A combustible mixture is formed which is oxidized or burned in the at least one combustion chamber 39.

The illustrated structural form of the burner 35 is merely a preferred embodiment. The burner head 36 according to the invention, which will be described in more detail further below, may also be used advantageously in other structural forms of burners 35.

FIG. 3 shows, in longitudinal section, a burner head 36' in the form of a burner flange according to the prior art. A number of oxidant ducts 3' arranged concentrically around the burner longitudinal axis 1' are formed in the flange-like main body 2', which oxidant ducts extend in each case along duct longitudinal axes 20'. Furthermore, the main body 2' bears, centrally, a pilot fuel nozzle 19' for forming a pilot stage 11'. In each case, one fuel nozzle 4' projects into the oxidant ducts 3', which fuel nozzles are according to the prior art formed as nozzle lances and are situated concentrically with respect to the respective duct longitudinal axes 20'. In a manner not shown in detail but described above, the fuel nozzles 4' in the form of nozzle lances are fastened to the flange-like main body 2, are sealed off with respect to the latter and are fed with fuel via separate fuel distributors with hoses or pipelines or the like.

By means of the fuel nozzles 4' in the form of nozzle lances, fuel is introduced in the same direction, and coaxially, into the oxidant flow conducted through the oxidant ducts 3', whereby an oxidizable or combustible mixture is formed. The oxidant ducts 3' together with the associated fuel nozzles 4' form a main stage 12'.

Figure 9:
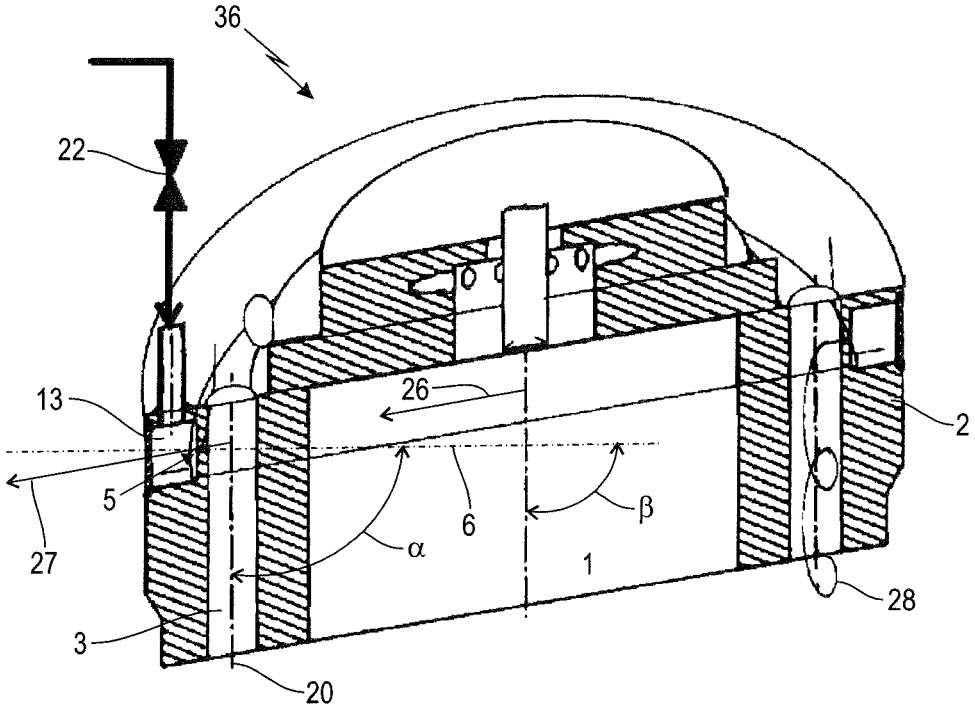
FIG. 9 shows, in a perspective longitudinal section, the burner head as per FIG. 4 for the purposes of illustrating different angles of the nozzle axes with respect to the burner longitudinal axis and/or with respect to the respective duct longitudinal axes, and the resulting flow pattern.

FIG. 4 shows, in longitudinal section, a first embodiment of a burner head 36 according to the invention, which is similar in terms of its configuration to the burner head 36 as per FIG. 2. Here, identical features are denoted by the same reference designations, wherein some features have already been described further above in conjunction with FIG. 2. In the main body 2 there is formed at least one supply duct 13, which in this case, in a preferred embodiment, runs in the main body 2 in at least partially and especially fully encircling fashion around the burner longitudinal axis 1. The supply duct 13 is supplied with fuel through an especially single fuel feed 9, wherein the fuel feed 9 may have a throughflow limiting element 22, which is not shown here but is shown in FIGS. 1 and 9. The supply duct 13 is formed as an at least partially encircling ring-shaped groove 15 in the main body 2, wherein the ring-shaped groove 15 is sealingly closed on its open side. The main body 2, which as a rotary body encircles the burner longitudinal axis 1, has a radially outer circumferential surface 17 in which the ring-shaped groove 15 is formed from the outside and closed off radially at the outside.

Furthermore, the burner head 36 has, for each oxidant duct 3, in each case at least one, in this case exactly one, fuel nozzle 4. From the schematic of FIG. 10, it can be seen that, here, by way of example, eight oxidant ducts 3 are provided with respective fuel nozzles 4. Some other number may however also be practical. The fuel nozzles 4 are at least partially, in this case all, formed by fuel ducts 5 which, in turn, are formed into the main body 2, wherein the fuel ducts 5 are connected on their inlet side to the supply duct 13 and open out on their outlet side into the corresponding oxidant duct 3. Thus, the fuel nozzles 4 or the fuel ducts 5 are at least partially, and in this case all, connected to the supply duct 13 for the supply of fuel.

Figure 10:
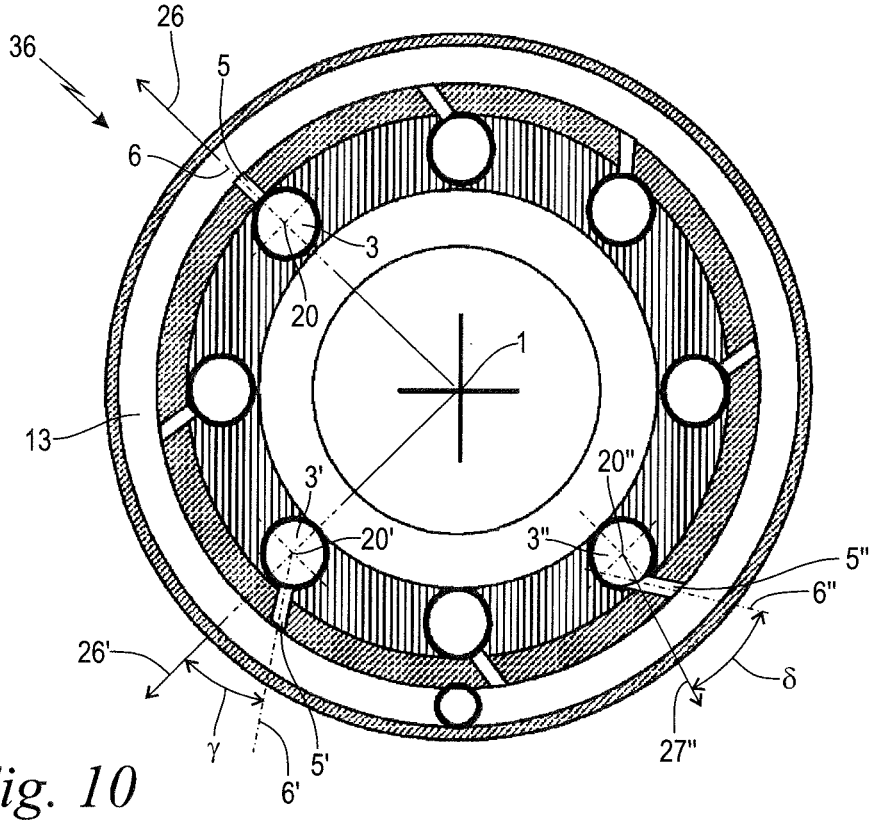
FIG. 10 shows, in schematic cross section, the burner head as per FIG. 4 for the purposes of illustrating an optional angle of twist of the respective nozzle axes.

The fuel ducts 5 have nozzle axes 6 which have a radial direction component with respect to the duct longitudinal axis 20 of the oxidant duct 3 and/or with respect to the burner longitudinal axis 1 of the burner head 36. In the embodiment shown, the duct longitudinal axes 20 lie axially parallel to the burner longitudinal axis 1, such that the radial direction components apply equally relative to the duct longitudinal axis 20 and relative to the burner longitudinal axis 1. The axial parallelism however is not imperative, such that the radial direction component applies at least in relation to one of the two axes. The longitudinal section view shown leads to a section plane which is spanned by the burner longitudinal axis 1 and a radial direction 26 with respect thereto. In a same section plane (but possibly also a different section plane), a further section plane is spanned by the duct longitudinal axis 20 and a radial direction 27 with respect thereto. In the section planes, the nozzle axis 6 lies at a first angle of inclination a relative to the duct longitudinal axis 20 and at a second angle of inclination β relative to the burner longitudinal axis 1. The first and second angles of inclination α, β advantageously lie in a range from>0° to 90° inclusive, and preferably in a range from 60° inclusive to 90° inclusive. In the embodiment shown, both angles of inclination α, β are at least approximately 90°. Further details of the burner head 36 as per FIGS. 2 and 4 and in particular further details relating to the angular position of the nozzle axes 6 are shown in FIGS. 9 and 10, and will be described in more detail below in conjunction with the figures.

Figure 5:
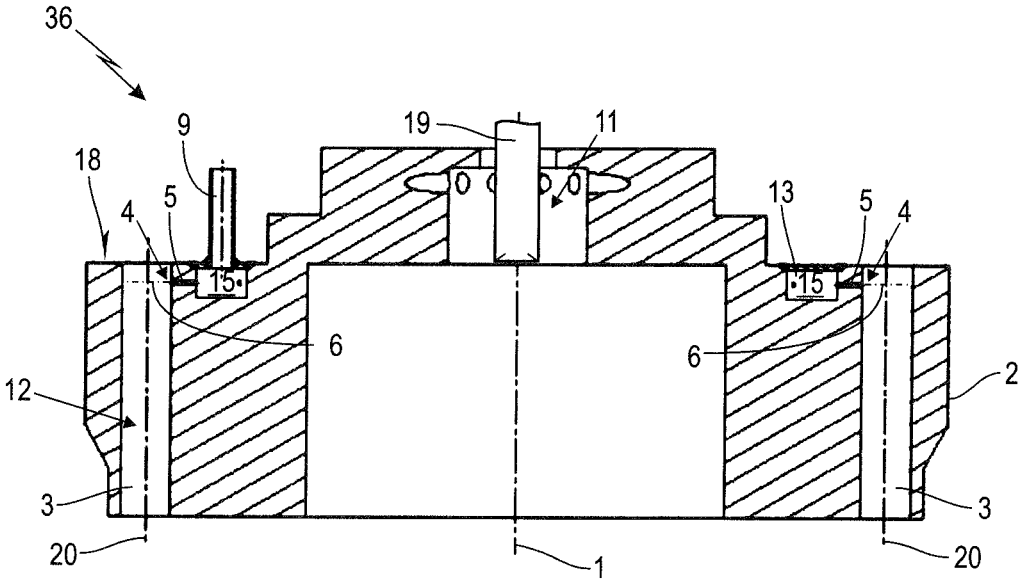
FIG. 5 shows a variant of the arrangement as per FIG. 4, wherein the ring-shaped supply duct is formed in an end face of the burner head.

FIG. 5 shows a variant of the arrangement as per FIG. 4, wherein the supply duct 13, in the form of a ring-shaped groove 15, is formed not in the circumferential surface 17 (FIG. 4) but rather in an end face surface 18 lying perpendicular to the burner longitudinal axis 1. The supply duct 13 may, as in the embodiment as per FIG. 4, encircle the multiplicity of oxidant ducts 3 at the outside, but in the embodiment as per FIG. 5, the supply duct 13 is situated radially to the inside of the oxidant ducts 3. Accordingly, the fuel ducts 5 lead from the supply duct 13 into the oxidant ducts 3 not with a radial direction component from the outside to the inside but rather, conversely, with a radial direction component from the inside to the outside. In terms of the other features and reference designations, the embodiment as per FIG. 5 corresponds to that in FIG. 4.

Figure 6:
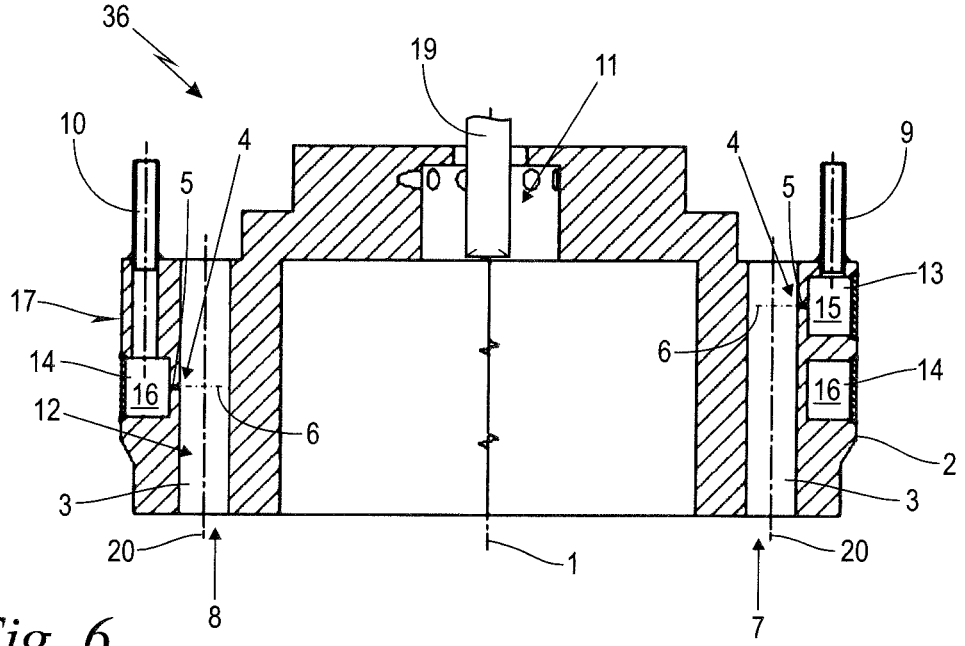
FIG. 6 shows a further variant of the burner head as per FIG. 4 or 5 with two separate supply ducts in the circumferential surface for the supply of fuel to two independent burner stages of a main stage of the burner.

FIG. 6 shows, in longitudinal section, a further variant of the burner head 36 as per FIG. 4 or 5. Here, the oxidant ducts 3 and the associated fuel nozzles 4 or fuel ducts 5 are divided at least, in this case exactly, into a first burner stage 7 and a second burner stage 8. The at least two, in this case exactly two, burner stages 7, 8 together form the main stage 12. Furthermore, the burner head 36 has a central pilot stage 11 with the associated pilot fuel nozzle 19. The main stage 12, which is divided into the two burner stages 7, 8, or the oxidant ducts 3 and fuel ducts 5 thereof, are arranged concentrically around the pilot stage 11. For the different burner stages 7, 8, separate and mutually independent fuel feeds 9, 10 are provided, which may, as shown in FIGS. 1 and 9, be provided with independent throughflow limiting elements 22.

The two fuel feeds 9, 10 lead into two mutually separate supply ducts 13, 14, which are both formed in the circumferential surface 17 of the main body 2 as ring-shaped grooves 15, 16 with mutual axial offset. The two ring-shaped grooves 15, 16 with the associated fuel ducts 5 are formed correspondingly to the ring-shaped groove 15 as per FIG. 4. The fuel ducts 5 of the upper supply duct 13 open into at least one, preferably into a first, group of multiple oxidant ducts 3, whereas the fuel ducts 5 open into at least one other, preferably into a second, group of multiple oxidant ducts 3. In this way, it is possible, as required, for individual oxidant ducts 3 or individual groups thereof to be deactivated or operated with different operating parameters than respective other oxidant ducts 3 or another group thereof. In other words, it is possible for the two burner stages 7, 8 of the main stage 12 to be operated independently of one another and, if required, also individually deactivated.

Figure 7:
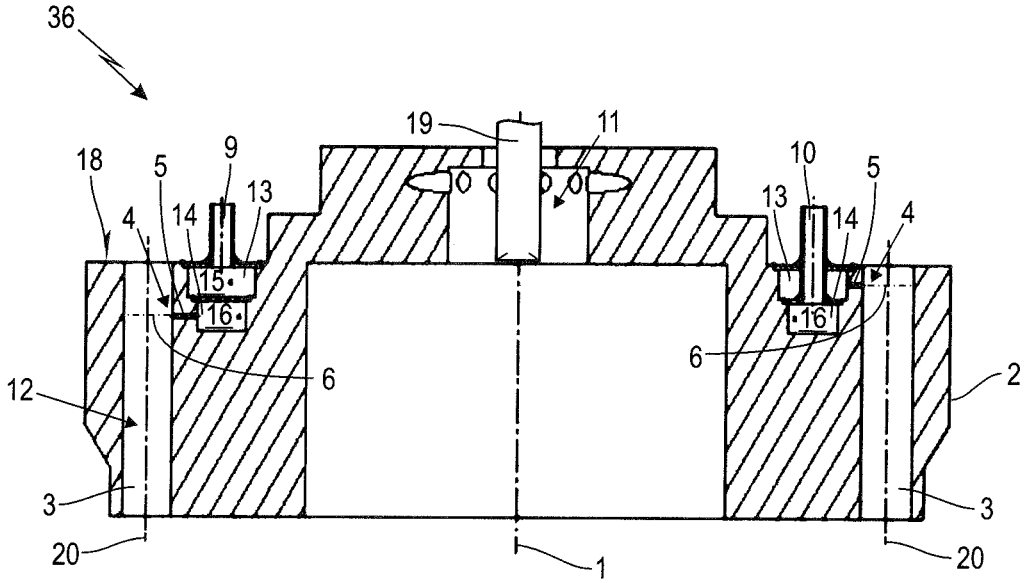
FIG. 7 shows a modification of the burner head as per FIG. 6, wherein the two separate supply ducts are formed in the face surface of the burner head.

FIG. 7 shows a modification of the burner head 36 as per FIG. 6, in which the two separate supply ducts 13, 14 are formed in the end face of the burner head 36 or of the main body 2 thereof. These are two ring-shaped grooves 15, 16 which are formed into the end face 18 of the main body 2 similarly to the embodiment as per FIG. 5, which ring-shaped grooves 15, 16 are, in the preferred embodiment shown, arranged one above the other in an axial direction and are separated from one another by a separating plate. The first fuel feed 9 opens directly into the upper ring-shaped groove 15; whereas, the second fuel feed 10 is led from above through the upper ring-shaped groove 15 and opens, below the latter, into the ring-shaped groove 16. Alternatively, it is possible for the two supply ducts 13, 14 or the two ring-shaped grooves 15, 16 to be radially offset with respect to one another, wherein, for example, one supply duct 13 may be positioned radially to the inside of the oxidant ducts 3 and the other supply duct 14 may be positioned radially to the outside of the oxidant supply ducts. With regard to the further configuration, the supply ducts 13, 14 or the associated ring-shaped grooves 15, 16 correspond to the supply duct 13 or to the ring-shaped groove 15 of the embodiment as per FIG. 5.

Figure 8:
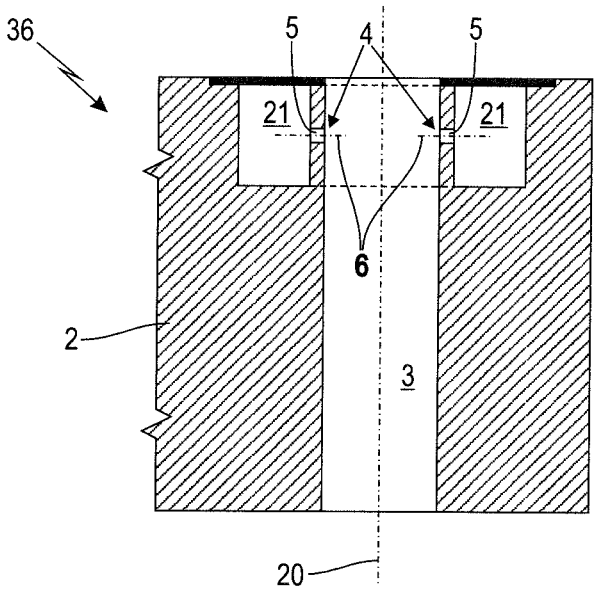
FIG. 8 shows, in a schematic detail illustration, a single oxidant duct as per FIGS. 4 to 7 with an optional ring-shaped duct encircling the oxidant duct.

FIG. 8 shows, in a schematic detail illustration, a single oxidant duct 3 as per FIGS. 4 to 7 with an optional ring-shaped duct 21 encircling the oxidant duct 3 in ring-shaped fashion. The ring-shaped duct 21 is connected, in a manner not shown in any more detail, to one of the two above-described supply ducts 13, 14, and is supplied with fuel in this way. The ring-shaped duct 21 encircles the oxidant duct 3 in at least partially closed form. In FIG. 8, the ring-shaped duct 21 encircles the oxidant duct entirely in closed form. In the embodiment shown, this ring-shaped duct is in the form of a ring-shaped groove which is closed off in the upward direction by a cover 25 or by a cover plate. From the ring-shaped duct 21, at least one fuel duct 5, in this case multiple fuel ducts 5 with associated nozzle axes 6, lead into the oxidant duct 3.

Unless expressly stated or illustrated to the contrary, the embodiments as per FIGS. 2 and 4 to 8 correspond to one another in terms of their other features, reference designations and optional configuration options, wherein a combination of such features, such as for example the combination of an end face supply duct 13 with a circumferential supply duct 14, is also possible.

FIG. 9 shows, in a perspective longitudinal section, the burner head 36 as per FIGS. 2 and 4 for the purposes of illustrating different angles of the nozzle axis 6. By contrast to the schematic as per FIG. 4, the nozzle axes 6 have first and second angles of inclination α, β which are less than 90°. The two angles of inclination α, β are in this case configured such that, in the case of a magnitude of <90°, the corresponding nozzle axis 6 is inclined from the supply duct 13 toward the oxidant duct 3 in the throughflow direction or toward the outlet of the oxidant duct 3. With regard to the magnitudes in question of the two angles of inclination α, β, that which has been stated in conjunction with FIG. 4 applies.

FIG. 10 shows, in a schematic cross-sectional illustration, the burner head as per FIGS. 2, 4 and 9 for the purposes of illustrating further optional angular positions of the nozzle axes 6. The cross-sectional plane shown here lies perpendicular both to the burner longitudinal axis 1 and to the corresponding duct longitudinal axis 20. If, by contrast to the illustration of FIG. 10, the duct longitudinal axes 20 do not lie axially parallel to the burner longitudinal axis 1, then the two stated cross-sectional planes are not congruent. For a better overview, FIG. 10 illustrates three different fuel ducts 5, 5', 5" with associated nozzle axes 6, 6', 6". In practice, however, in a single burner head 36, use is preferably made of only one structural form of the fuel ducts 5, 5', 5" with nozzle axes 6, 6', 6" as described in more detail below. A combination of these is, however, also possible.

In a first optional embodiment, the nozzle axis 6 of the fuel duct 5 lies exactly radially with respect to the burner longitudinal axis 1, that is, with respect to the radial direction 26, in the cross-sectional plane measured perpendicular to the burner longitudinal axis 1. Thus, the nozzle axis 6 runs through the burner longitudinal axis 1. Furthermore, the nozzle axis 6 of the fuel duct 5 lies exactly radially with respect to the duct longitudinal axis 20, that is, runs exactly to the duct longitudinal axis 20, in the cross-sectional plane lying perpendicular to the duct longitudinal axis 20.

In a further optional embodiment, the nozzle axis 6' of the fuel nozzle 5', as measured in the cross-sectional plane lying perpendicular to the burner longitudinal axis 1, lies at a lateral angle $\gamma$ with respect to the burner longitudinal axis 1, such that the nozzle axis 6' does not run through the burner longitudinal axis 1. However, the nozzle axis 6' does run through the associated duct longitudinal axis 20'. From the burner longitudinal axis 1, a radial direction 26' runs through the associated duct longitudinal axis 20', wherein the lateral angle $\gamma$ is measured between the radial direction 26' and the nozzle axis 6'.

Finally, a further optional embodiment of a fuel duct 5" with a nozzle axis 6" is shown. Here, the nozzle axis 6" of the fuel duct 5", as measured in the cross-sectional plane lying perpendicular to the duct longitudinal axis 20", lies at an angle of twist $\delta$ with respect to the duct longitudinal axis 20". From the duct longitudinal axis 20", a radial direction 27" runs to the mouth of the fuel duct 5", wherein the angle of twist $\delta$ is measured between the radial direction 27" and the nozzle axis 6".

In addition to the angle of twist $\delta$, the nozzle axis 6" has a lateral angle $\gamma$, which is not shown here but which is shown in the case of the nozzle axis 6'. It is also possible for the nozzle axis 6" to be positioned with an angle of twist $\delta$ but without a lateral angle $\gamma$. Conversely, the nozzle axis 6' has only the lateral angle $\gamma$, whereas the angle of twist $\delta$(not shown there) is zero. The nozzle axis 6 of the fuel duct 5 has neither a lateral angle $\gamma$ nor an angle of twist $\delta$. In other words, the magnitudes of the lateral angle $\gamma$ and of the angle of twist $\delta$ are equal to 0. At least by means of the arrangement of the nozzle axis 6" with an angle of twist $\delta$, alternatively or combinatively also with a lateral angle $\gamma$ and with angles of inclination $\alpha$, $\beta$, it is possible to realize a swirling introduction of fuel into the respective oxidant duct 20, correspondingly to a spiral line 28 in FIG. 9, for good mixing of the fuel with the oxidant.

Figure 11:
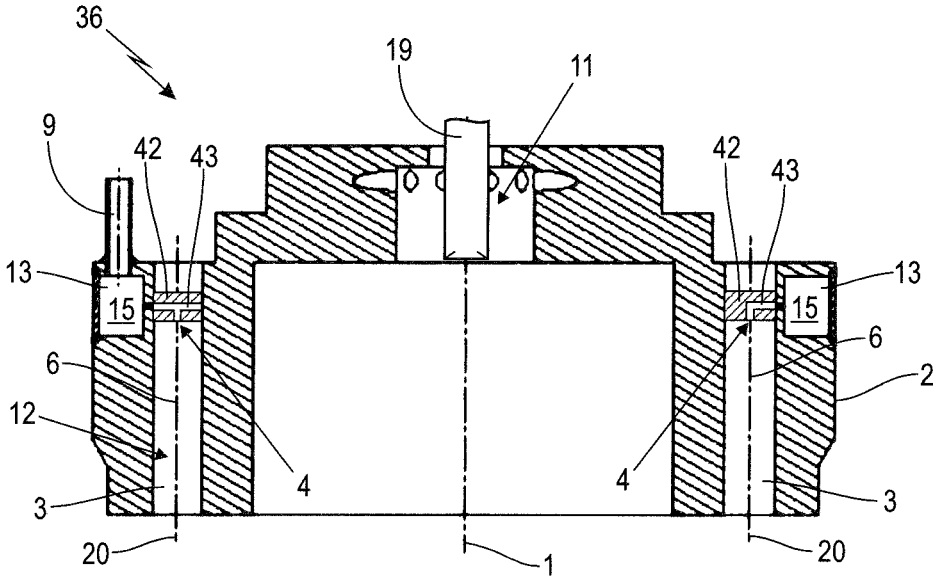
FIG. 11 shows a variant of the arrangement as per FIG. 4 with two differently configured fuel duct bodies which are led into the respective oxidant ducts, wherein the respective fuel nozzles are formed on the fuel duct body and is arranged at least approximately on the duct longitudinal axis, wherein, in one embodiment, the fuel nozzle is connected to a continuous fuel duct section running transversely with respect to the duct longitudinal axis, and wherein, in the other embodiment, the fuel nozzle is fed from an angled fuel duct section.
Figure 12:
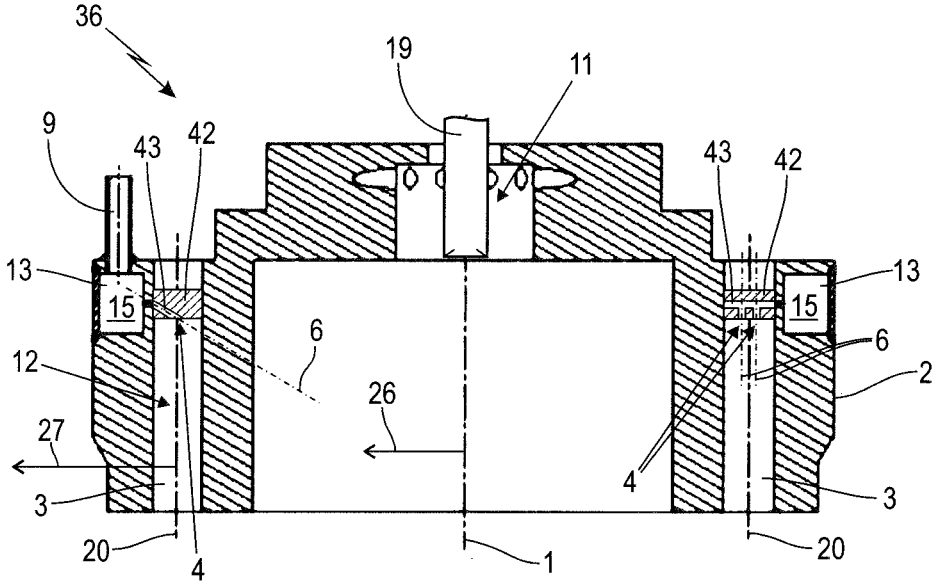
FIG. 12 shows the arrangement as per FIG. 11 with alternatively configured fuel duct bodies, wherein, in one embodiment, the fuel nozzle is fed through an obliquely running fuel duct section, and wherein, in the other embodiment, two fuel nozzles close to the axis are connected to a fuel duct section running transversely with respect to the duct longitudinal axis.

FIGS. 11 and 12 also show variants of the embodiment as per FIG. 4, wherein, instead of a fuel duct 5 (FIG. 4) which is formed in the main body 2 and which forms the corresponding fuel nozzle 4, a fuel duct body 42 is provided which is led into the associated oxidant duct 3. The fuel duct body 42 is, in FIGS. 11 and 12, illustrated in a total of four different embodiments, wherein, in practice, it is preferable for multiple fuel duct bodies 42 of the same structural form to be used. It is, however, also possible for mixed structural forms to be provided within a burner head 36.

Common features of the different fuel duct bodies 42 are the formation of at least one fuel nozzle 4 on corresponding ones of the fuel duct bodies 42, and the optional, preferred positioning of the fuel nozzle 4 at least approximately on the duct longitudinal axis 20. In all cases, there is situated within the fuel duct body 42 a fuel duct section 43 for the feed of fuel to the fuel nozzle 4. It is preferable, but not imperative, for the fuel duct section 43 to be fed from an associated supply duct 13, 14, as has been described above in conjunction with FIGS. 4 to 7, 9 and 10.

It may suffice for the corresponding fuel duct body 42 to project in cantilevered fashion into the associated oxidant duct 3 only from one side. In the preferred embodiments, this fuel duct body is led into the corresponding oxidant duct 3 so as to extend all the way across the latter transversely with respect to its duct longitudinal axis 20 and so as to be supported at both ends on the opposite walls of the corresponding oxidant duct 3. In the preferred embodiments shown, the fuel duct bodies 42 have a circular cross section, wherein the fuel duct bodies are in this case of altogether cylindrical form. Use may however also be made of different cross-sectional shapes, especially for the purposes of reducing the flow resistance, such as for example elliptical, droplet-shaped or other streamlined cross-sectional shapes.

In the embodiment in the left-hand half of FIG. 11, the fuel duct section 43 is formed as a passage bore which extends all the way through the fuel duct section 43 in its longitudinal direction, that is, perpendicular to the duct longitudinal axis 20. As an alternative to this, it is also possible for a shortened fuel duct section 43 in the form of a blind bore to be provided which extends only as far as the fuel nozzle 4, as per the right-hand half of FIG. 11. In both cases, a duct section, which forms the fuel nozzle 4, branches off at right angles from the fuel duct section and coaxially with respect to the duct longitudinal axis 20, wherein the associated nozzle axis 6 is congruent with the duct longitudinal axis 20. Axial parallelism with a spacing between the nozzle axis 6 and the duct longitudinal axis 20 may however also be practical.

A further variant is shown in the right-hand half of FIG. 12, wherein, instead of a single fuel nozzle 4, multiple, in this case two, fuel nozzles 4 are formed on a fuel duct body 42, which fuel nozzles are situated with a spacing to the duct walls of the associated oxidant duct 5 and especially in the vicinity of the associated duct longitudinal axis 20. The multiple fuel nozzles 4 are advantageously fed from a common fuel duct section 43. Instead of the continuous fuel duct section 43 shown here, it may however also be practical for a shortened fuel duct section 43 to be provided, analogously to the right-hand half of FIG. 11. In any case, in all three embodiments described above, the fuel nozzles 4 are oriented in the throughflow direction of the oxidant duct 3, wherein an at least approximately central injection of the fuel into the corresponding oxidant duct 3 takes place.

Finally, the left-hand half of FIG. 12 also shows a further variant with a non-branched fuel duct section 43 leading obliquely through the fuel duct body 42. Here, the fuel duct section 43 forms the fuel nozzle 4 directly at its outlet end, the nozzle axis 6 of which fuel nozzle is identical to the fuel duct axis. The nozzle axis 6 thus has both an axial direction component and a radial direction component with respect to the plane of the burner longitudinal section shown here. In other words, the nozzle axis 6 lies at an angle which differs from 0° and 90° with respect to the direction of the burner longitudinal axis 1 or the duct longitudinal axis 20 and also with respect to the direction of the respectively associated radial direction 26, 27. In particular in the case of such an oblique orientation of the nozzle axis 6, it may be practical for the fuel nozzle 4 to duly be arranged with a spacing to the duct walls of the associated oxidant duct 5 but so as to also maintain a spacing to the duct longitudinal axis 20 of the oxidant duct 3. Utilizing the radial direction component of the emerging fuel, it is possible in this way to realize an equivalent to the central and coaxial infeed of fuel as per the other embodiments of FIGS. 11 and 12.

Unless expressly stated otherwise, the various embodiments of the fuel duct body 42 correspond in terms of their other features and reference designations, which also applies to the comparison of the burner heads 36 as per FIGS. 11 and 12 with the burner head 36 as per FIG. 4. Furthermore, the fuel duct bodies 42 according to the invention may also be used in any other burner heads, in particular in burner heads 36 according to the further embodiments described here overall.

Figure 13A:
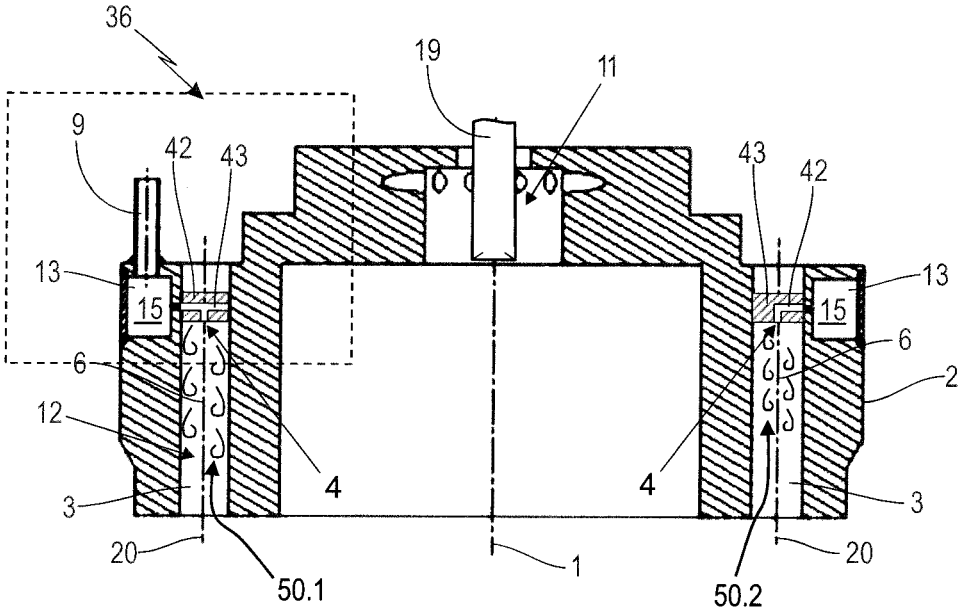
FIG. 13A shows the arrangement as per FIG. 11 with an enlargement region marked by dashed lines and with schematically indicated vortex wakes, caused by the fuel duct bodies, in the oxidant duct.
Figure 13B:
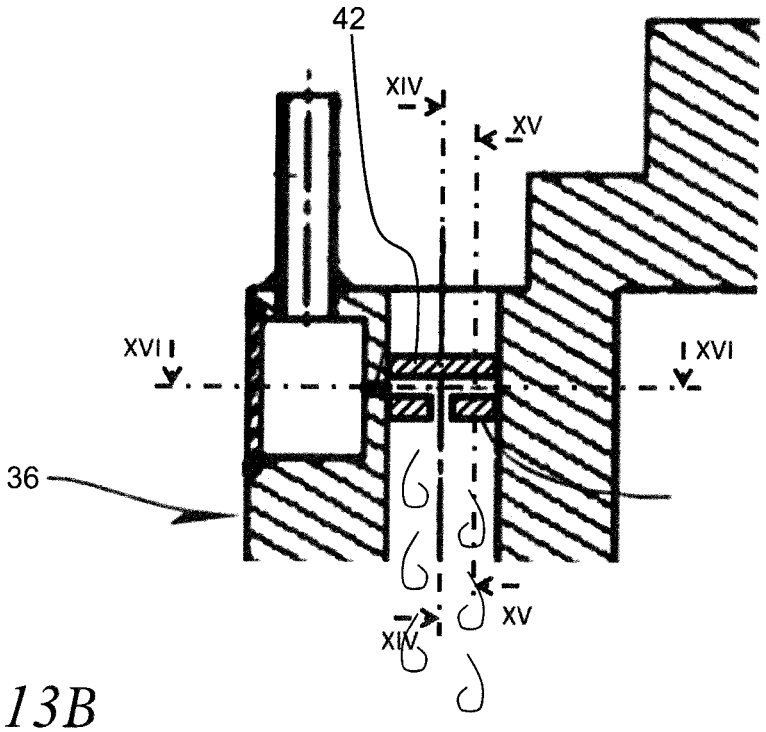
FIG. 13B shows an enlarged detail of the enlargement region as per FIG. 13A with section planes XIV-XIV, XV-XV and XVI-XVI passed through the fuel duct body.

For better orientation, FIG. 13A shows once again the view of the embodiment of FIG. 11 as already described above, wherein, by means of the box with dashed lines, an enlargement region is selected which is illustrated on an enlarged scale in FIG. 13B. Furthermore, in the illustration of FIG. 13A, vortex streets 50.1, 50.2 are symbolically indicated in each of the two oxidant ducts 3 shown by way of example, wherein, in the sectional views of FIGS. 13A and 13B, the vortex symbols have, for better illustration, been shown rotated through 90° about the duct longitudinal axis 20 in relation to the true form of Karman vortices on a bluff body. The different extents of the illustrations of the vortex streets 50.1, 50.2 are intended here to indicate the variability and variance, already described in the introduction, of the vortex formation in a manner dependent on the geometries of the fuel duct bodies 42 as bluff bodies in the oxidant flow.

FIG. 13B shows the region around a fuel duct body 42 of the burner head 36 with three section planes XIV-XIV, XV-XV and XVI-XVI through the fuel duct body 42, which will be discussed in FIGS. 14A to 14H, 15A to 15H and 16A to 16D as described below.

Figure 14A:
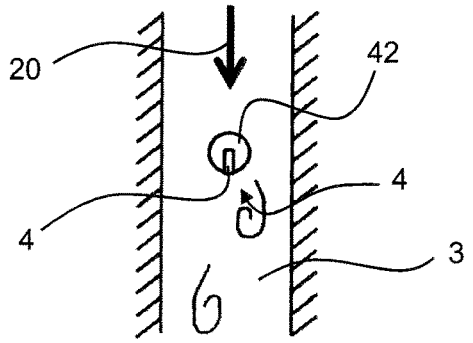
FIGS. 14A to 14H show sectional views, in the section plane XIV-XIV, of different variants of the fuel duct body.
Figure 14B:
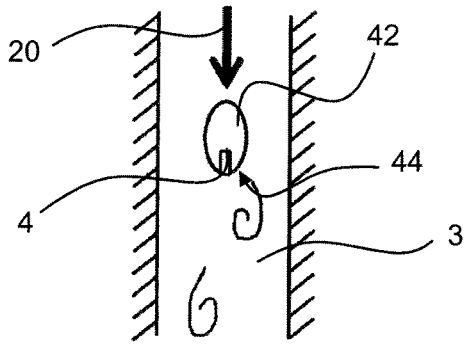
Figure 14C:
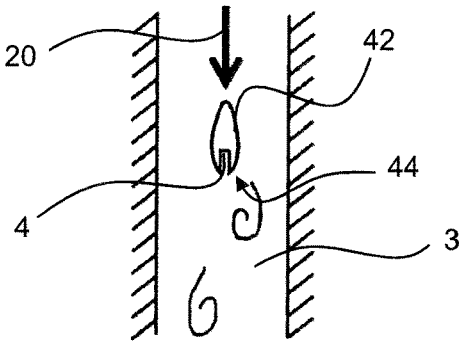
Figure 14D:
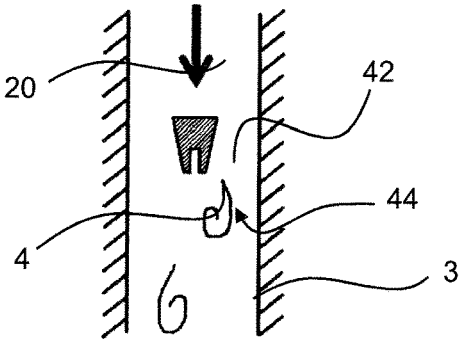
Figure 14E:
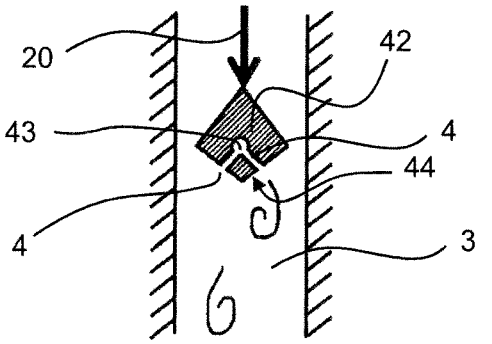
Figure 14F:
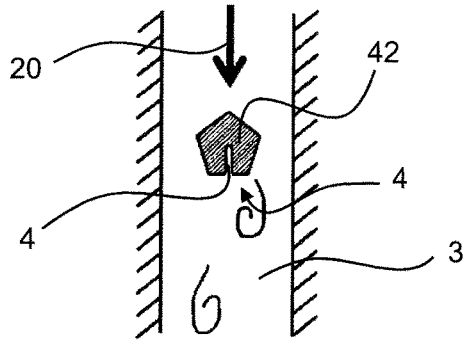
Figure 14G:
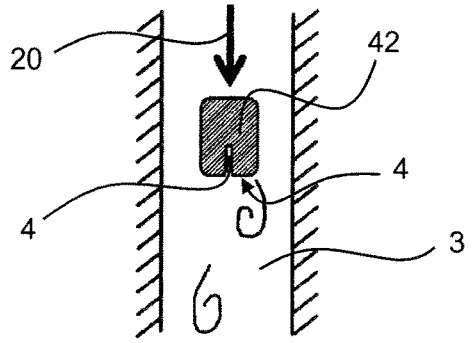
Figure 14H:
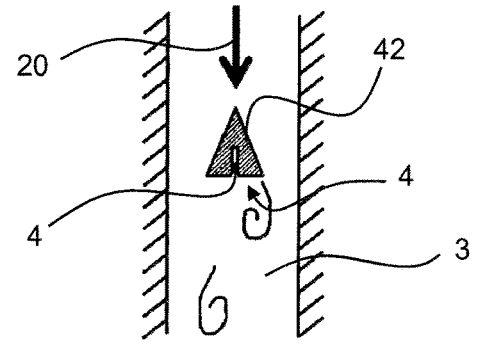

FIGS. 14A to 14H show different exemplary variants of the body cross section, in particular at the level of the duct longitudinal axis 20 of the oxidant duct 3, of the fuel duct body 42. Here, circular or oval cross sections (FIGS. 14A to 14C) and polygonal cross sections (14D to 14H) are explicitly shown. The embodiment of a polygonal cross section with rounded corners or edges, as shown in FIG. 14G, has an additional influence on the vortex formation in the vortex street 50. The feature of the corner or edge rounding may in this case be applied analogously to the other polygonal embodiments shown, with a similar effect on the vortex formation. Here, in FIGS. 14A to 14H the vortex symbols are now illustrated in the correct rotational position about the duct longitudinal axis.

The fuel duct bodies 42 illustrated in detail in FIGS. 14A to 14D and 14F to 14H each have a fuel nozzle 4 which is directed into the oxidant duct 3 and which is in the form of a nozzle bore which is preferably oriented parallel to the flow direction of the oxidant along the duct longitudinal axis 20. In the preferred embodiments of FIGS. 14D and 14F to 14G, the fuel nozzle 4 is furthermore oriented substantially perpendicular to an outflow surface 45 which is oriented downstream and which is preferably oriented perpendicular to the duct longitudinal axis 20 and which forms an outflow geometry 44 of the respective fuel duct body. In this way, the fuel is injected into the vortices substantially tangentially with respect to the vortex street 50 that forms, preferably directly into the wake. An analogous injection is realized in the examples as per FIGS. 14A to 14C by virtue of the fuel nozzle 4 in the fuel duct body 42 being oriented substantially parallel to the duct axis 20. It may however also be provided that at least the fuel nozzle 4 is configured to be tilted at a nozzle angle with respect to a surface normal of the outflow surface 45, in order to preferably ensure as short as possible a residence time of the fuel in the vicinity of the injection point. It is also conceivable for more than one fuel nozzle 4 to be provided in the fuel duct body 42, which fuel nozzle may in particular also have different orientations with respect to the outflow surface 45 or with respect to the duct longitudinal axis 20 (see for example FIG. 14E).

FIG. 14E shows an example with an alternative outflow geometry 44 in the form of an outflow wedge with two outflow surfaces 45 oriented at an outflow angle with respect to one another. Here, in each outflow surface 45, there is provided a fuel nozzle 4 which injects or can inject the fuel at least with a radial impetus component into the oxidant. The radial impetus component may in this case be set by means of the outflow angle and/or the orientation of the fuel nozzle 4 with respect to the outflow surface 45. In the preferred embodiment as per FIG. 14E, the fuel nozzles 4 are substantially perpendicular to the outflow surface. Provision may however also be made for at least one of the fuel nozzles 4 to be configured to be tilted at a nozzle angle relative to a surface normal to the outflow surface 45.

FIGS. 15A to 15H show different exemplary variants of the cross section of a fuel duct body 42 in the section plane XV-XV of FIG. 13B, that is, with a spacing to the duct longitudinal axis 20 but parallel to the latter. The off-axis cross sections, shown here, of the body cross sections as per FIGS. 14A to 14H are intended to illustrate some further degrees of freedom for a person skilled in the art in configuring the fuel duct body 42 for the specific application or the operating characteristic map, which is to be covered by means of the burner head configuration, for oxidant flow and fuel injection. Here, the vortex symbols are illustrated in the correct rotational position about the duct longitudinal axis.

Figure 15A:
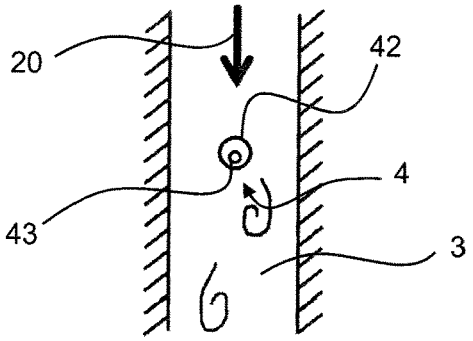
FIGS. 15A to 15H show sectional views, in the section plane XV-XV, of different variants of the fuel duct body.

In the example as per FIG. 15A, a diameter of the circular cross section of the fuel duct body 42 is reduced in relation to the cross section in the section plane XIV-XIV. This diameter reduction may in this case be provided in step fashion or preferably in continuous fashion at least in sections. However, different examples may also exist in which the diameter of the cross section in section plane XV-XV should be selected to be increased in relation to the diameter in the section plane XIV-XIV. Analogously, the cross section in the plane situated opposite the section plane XV-XV in relation to the duct longitudinal axis 20 may likewise be configured to be reduced or increased. For example, it may be advantageous for the cross section of the fuel duct body 42 to be formed so as to decrease in diameter from an end facing toward the supply duct 13, 15 to the opposite end. Furthermore, FIG. 15A shows the fuel duct section 43 running in the fuel duct body 42, which fuel duct section is, in this example, in the form of a preferably round bore.

Figure 15B:
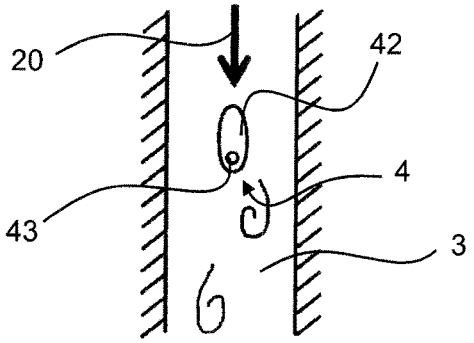

Analogously to the example as per FIG. 15A, it is the case in the example as per FIG. 15B that the outer dimensions of the cross section are reduced in the section plane XV-XV in relation to the embodiment in the section plane XIV-XIV in FIG. 14B. Here, it may be advantageous if, in addition, as illustrated in FIG. 15B, the oval cross section is formed to be altogether slimmer, that is, an eccentricity of the oval is formed so as to increase with increasing spacing from the duct longitudinal axis 20. Analogously to the example as per FIG. 15A, the fuel duct section 43 is in the form of a preferably round bore.

Figure 15C:
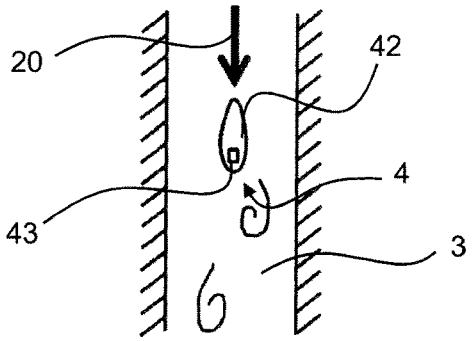
Figure 15D:
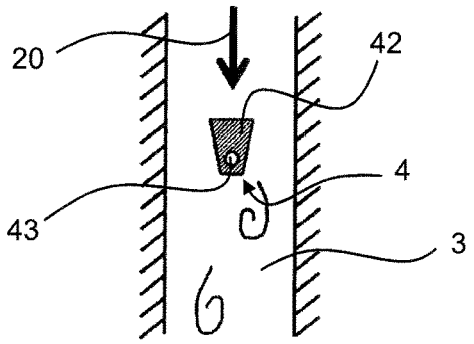
Figure 15E:
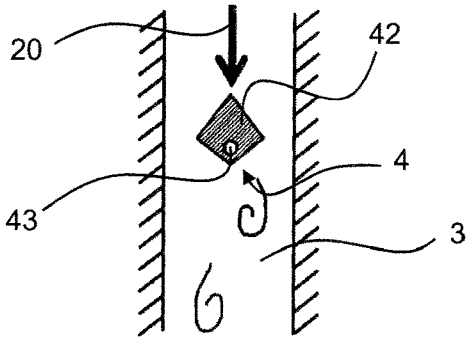
Figure 15F:
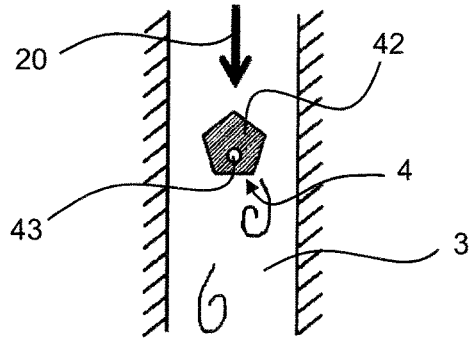
Figure 15G:
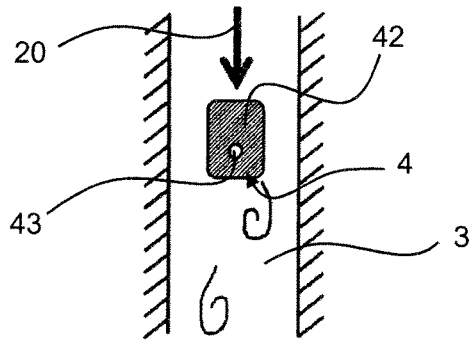
Figure 15H:
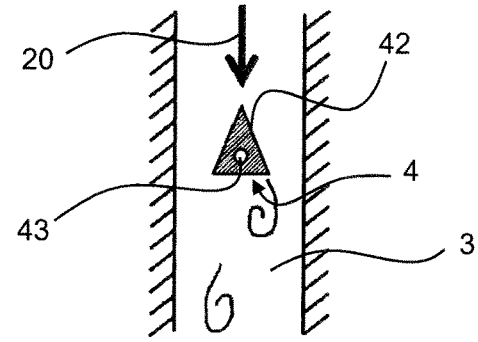

In the example of FIG. 15C, the cross section of the exemplary fuel duct body 42 in the section plane XV-XV is substantially identical to the cross section in the plane XIV-XIV (see FIG. 14C), with this cross section preferably being configured to be substantially constant over a transverse extent of the fuel duct body 42 through the oxidant duct 3. By contrast to the preceding examples, it is the case here that the fuel duct section 43 is of tetragonal form, wherein other polygonal or convex cross sections may also be provided. The duct cross sections may for example be produced by virtue of the duct being formed as a groove into the fuel duct body, which groove, in a second step, is closed again toward the shell surface of the fuel duct body 42.

The examples as per FIGS. 15D to 15H pick up on the variations shown in the preceding examples and apply them to the respective cross-sectional geometries without adding any significant aspects.

FIGS. 16A to 16D show cross sections through embodiments of a fuel duct body 42 in the section plane XVI-XVI, that is, at the level of the fuel duct section 43 along the duct longitudinal axis.

Figure 16A:
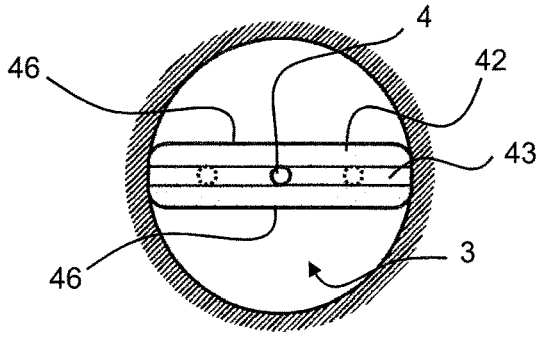
FIGS. 16A to 16D show sectional views, in the section plane XVI-XVI, of different variants of the fuel duct body.

In the example as per FIG. 16A, the transverse cross section (section plane XVI-XVI) of the fuel duct body 42 is substantially rectangular, and in particular, the two contour lines 46 which divide the oxidant duct 3 are oriented parallel to one another. In the simplest form, the side surfaces that generate the contour lines 46 in the projection of the section plane XVI-XVI are likewise oriented parallel to one another, leading to a cross section similar to the example as per FIGS. 14G and 15G. The side surfaces may however also be oriented at an angle with respect to one another, which, in the section planes XIV-XIV and XV-XV, would result in a cross section similar to the examples as per FIGS. 14D to 14F or 14G. The examples as per FIGS. 14A to 14C and 15A to 15C ultimately also have the potential to be combined with a transverse cross section as per FIG. 16A.

The example as per FIG. 16A also shows, as an alternative or additional embodiment of the example, the provision of further nozzle bores (circles with dashed lines) in the fuel duct body 42, which nozzle bores can be supplied with fuel via the fuel duct section 43.

Figure 16B:
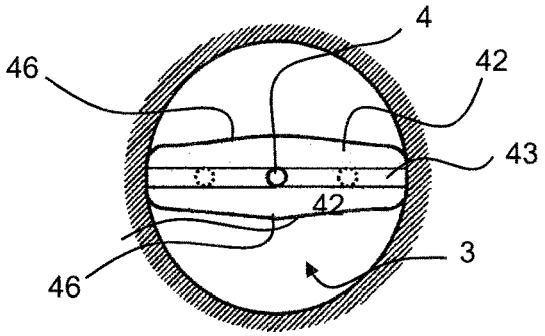
Figure 16C:
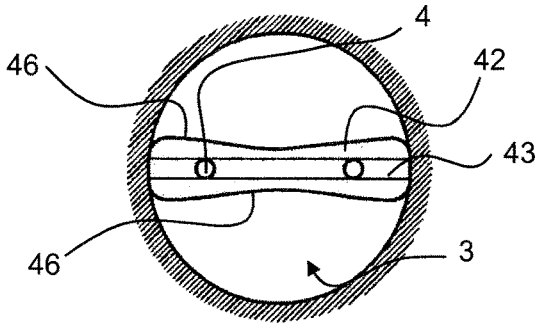
Figure 16D:
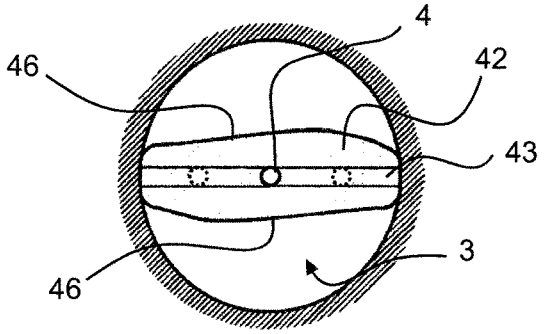

FIGS. 16B and 16C now show alternative cross sections of the fuel duct body 42 in the section plane XVI-XVI with convex and/or concave contour lines 46. Here, the contour lines 46 may be configured to be constant or variable along the duct longitudinal axis 20 which runs into the plane of the drawing, such that the respectively corresponding side surfaces of the fuel duct body may be formed so as to run parallel or in some other way relative to one another. The specific form is in this case dependent on the vortex characteristics of the flow duct body 42 that are to be achieved, and cannot be exhaustively illustrated at this juncture. It is however pointed out that, proceeding from the ideas and motivation disclosed here, and through combination of the disclosed features, a person skilled in the art can, for the specific usage situation, find the optimum configuration of a flow duct body 42 and thus of the vortex formation and/or vortex separation in the vortex street 50.

Figure 17:
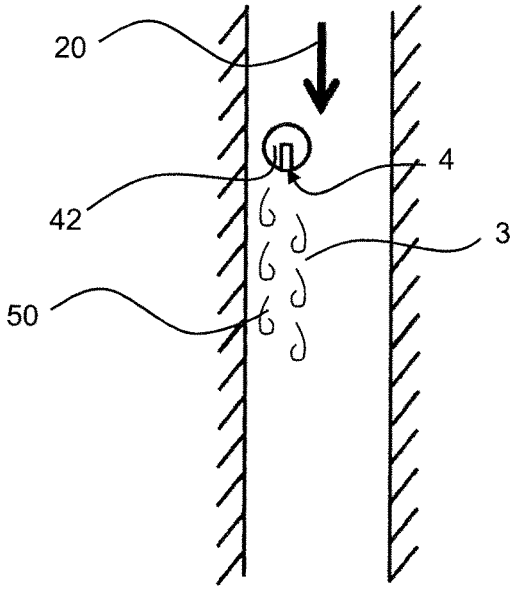
FIG. 17 shows a further exemplary arrangement of a fuel duct body in the oxidant duct.

In some usage situations, the vortex street 50 may under some circumstances introduce instabilities into the combustion chamber, or add to or intensify such instabilities. This is the case in particular if the vortices and/or vortex separations induced by the bluff-body effect of the fuel duct body 42 have a frequency close to a resonance frequency of the hot gas in the combustion chamber. Such instabilities can adversely affect the combustion characteristics. Aside from the geometrical configuration of the fuel duct body 42 as described above, a further alternative or additional possibility for influencing the effects of the fuel duct body 42 consists in providing an asymmetrical arrangement with respect to the respective oxidant duct 3. In this regard, FIG. 17 shows an embodiment in which the flow duct body 42 is arranged in the oxidant duct 3 with a spacing to the duct longitudinal axis 20. Here, the flow duct body 42 is preferably offset radially from the neutral filament of the oxidant flow with a certain spacing.

Figure 18:
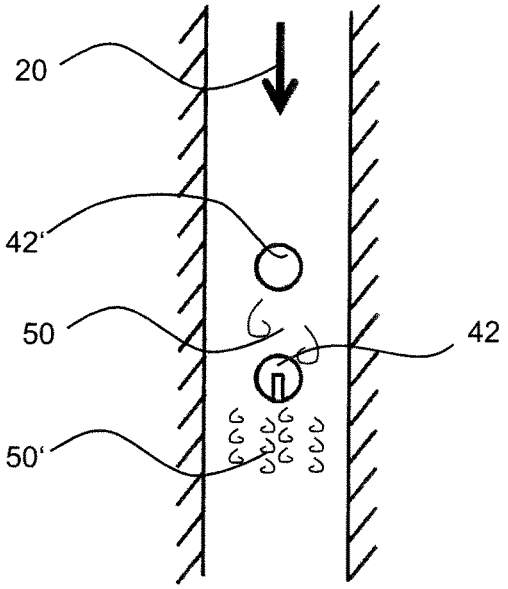
FIG. 18 shows an arrangement of multiple fuel duct bodies in the oxidant duct.

FIG. 18 shows a further alternative or additional possible means of reducing the effects that the vortex formation on the fuel duct body 42 has on the combustion chamber adjoining the burner head 35, the flame tube and the flameless oxidation taking place therein. For this purpose, at least one further bluff body 42' is arranged upstream of the fuel duct body 42 which for the injection of fuel into the oxidant. Here, the at least one further bluff body may however alternatively also be a further fuel duct body 42'. The by means of the bluff-body stage of the bluff body 42' positioned upstream, vortices with a first vortex characteristic (frequency, amplitude et cetera) are generated which, at the second bluff-body stage of the second fuel duct body 42, are at least partially broken up and converted into vortices with a different vortex characteristic, preferably with a smaller amplitude. Depending on the geometry of bluff body 42' and fuel duct body 42 and the spacing and offset thereof in the oxidant duct 3, it is possible to realize a reduction/elimination of the vortex street while maintaining increased turbulence into the introduction of the bluff bodies, and thus increased mixing of fuel with oxidant.

Figure 19:
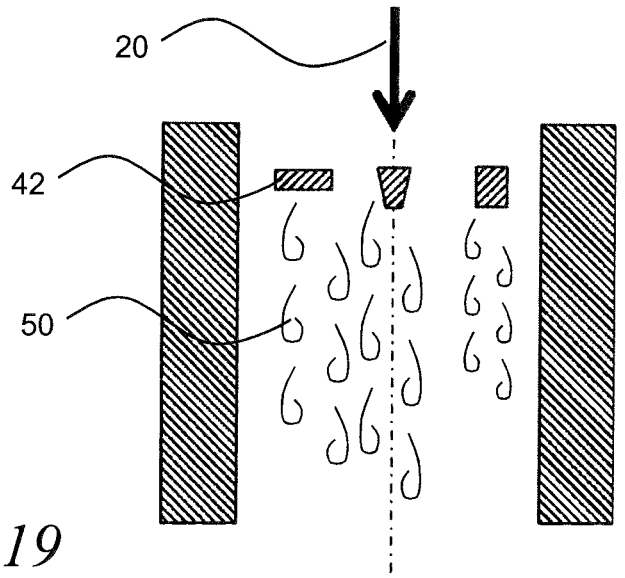
FIG. 19 shows a further arrangement of multiple fuel duct bodies in the oxidant duct.

FIG. 19 shows a further alternative or additional embodiment of the invention for suppressing instabilities, resonance phenomena or other states which have an adverse effect on the combustion behavior, in particular the stability of the flameless oxidation. If multiple fuel duct bodies 42 with different geometry are used in the oxidant duct, in particular are arranged in the oxidant duct 3, then each of the fuel duct bodies 42 generates its own vortex street 50 with a particular vortex characteristic, wherein the vortex characteristics at least of the fuel duct bodies 42 of different geometry differ from one another. In the example as per FIG. 19, three fuel duct bodies 42 are provided in an oxidant duct. The fuel duct bodies 42 are in this case arranged at the same axial height along the duct longitudinal axis 20 and parallel to one another. Each fuel duct body 42 has a geometry which differs from that of its neighbors, such that three partial vortex streets 50 with mutually different vortex characteristics are formed. The flow of oxidant and injected fuel that propagates into the adjoining combustion chamber of the burner thus takes the form of a mixture of vortices of different frequencies, separation tendencies and/or amplitudes. In this way, the formation of a dominant frequency in the gas cloud of the combustion space or combustion chamber is prevented in an effective manner.

Figure 20:
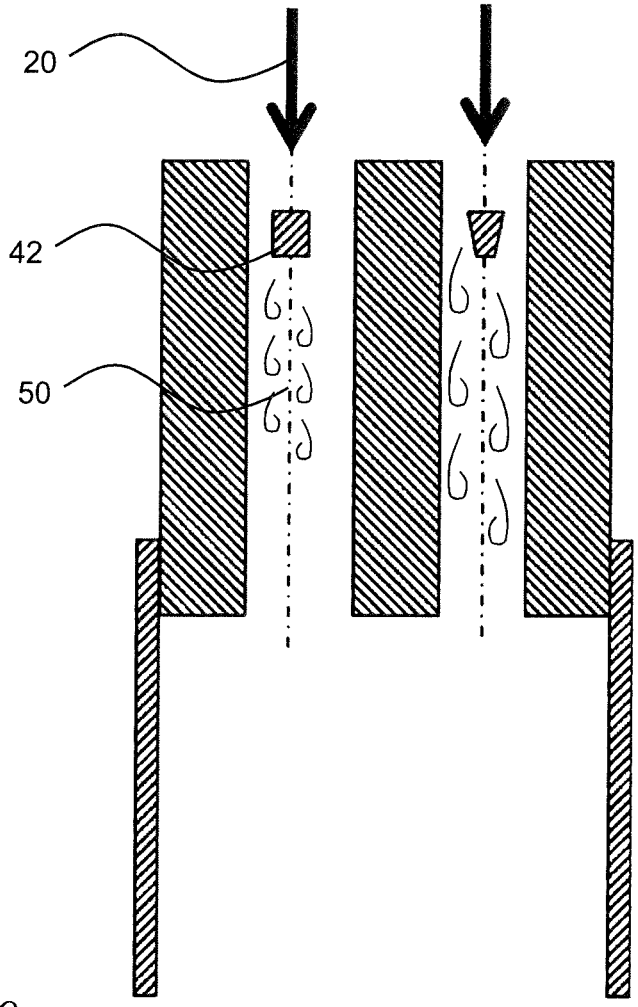
FIG. 20 shows a schematic view of a burner head with different fuel duct bodies in different oxidant ducts; and, FIG. 21 shows a schematic view of a burner head with a fuel duct body in which there are formed a fuel duct section and a gas duct section which jointly open into a fuel nozzle.

If, as indicated in FIG. 20, a burner head with at least two or more oxidant ducts 42 is used, it is possible, alternatively or in addition to the embodiment as per FIG. 19, for in each case one fuel duct body 42 to be provided in at least two oxidant ducts 3, which fuel duct bodies are of mutually different geometry and/or arrangement. This also yields in each case at least two vortex streets 50 with mutually different vortex characteristics, such that, as is already the case for example in FIG. 19, the flows of oxidant and injected fuel that propagate into the adjoining combustion chamber of the burner form, or merge to form, a mixture of vortices of different frequencies, separation tendencies and/or amplitudes. In this way, too, the formation of a dominant frequency in the gas cloud of the combustion space or combustion chamber is prevented in an effective manner.

Figure 21:
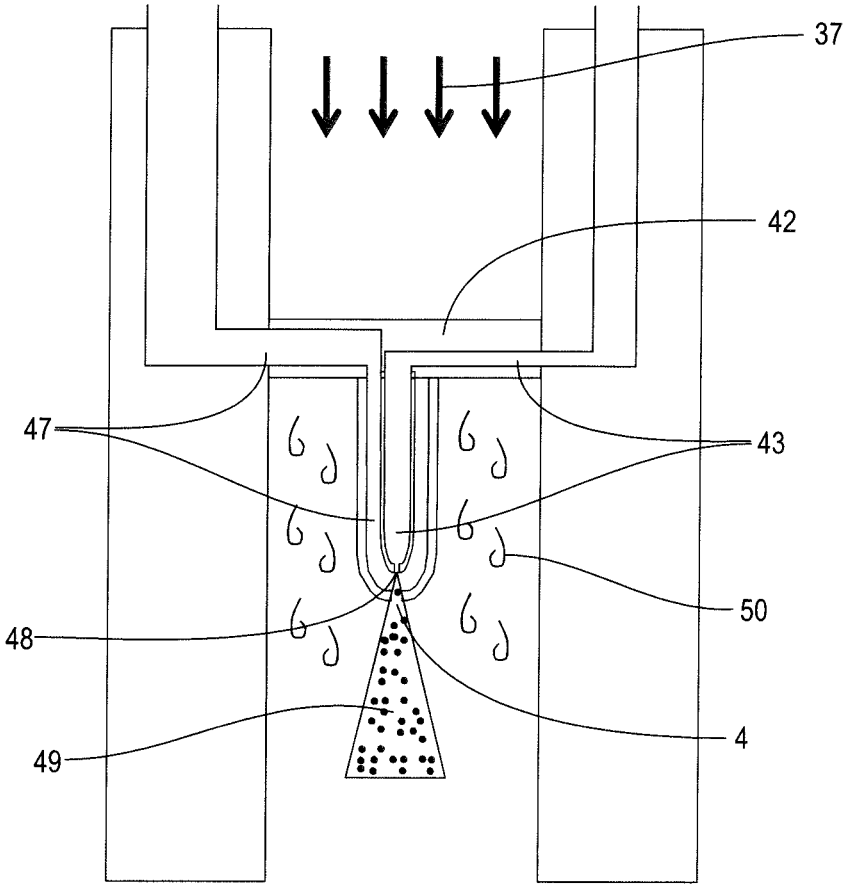

FIG. 21 shows a further schematic view of an oxidant duct 3 into which a fuel duct body 42 is led. More specifically, the fuel duct body 42 extends all the way through the oxidant duct 3, that is, leads from one duct wall to the opposite duct wall, wherein the fuel duct body acts as a bluff body, forming an indicated vortex street 50. For the sake of a better illustration, in FIG. 21, the vortex symbols are again shown rotated through 90° about the duct longitudinal axis. The fuel duct body 42 is equipped with at least one, in this case by way of example with exactly one, fuel nozzle 4. In the fuel duct body 42 there are formed a fuel duct section 43 and a gas duct section 47, which open out jointly into the at least one fuel nozzle 4 in a manner described in more detail below.

From a gas reservoir which is not illustrated, a gas, preferably an oxidative or oxygen-containing gas such as air, is conveyed through the gas duct section 47 to the region of the fuel nozzle 4. From a fuel reservoir which is likewise not illustrated, a liquid fuel is conducted through the fuel duct section 43 and through a connecting opening 48 into the gas duct section 47, wherein the connecting opening 48 is advantageously situated in the immediate vicinity of the fuel nozzle 4. At the inlet side of the fuel nozzle 4, a fuel-gas mixture 49 is formed, which in this case is a fuel-air mixture and which enters the oxidant duct 3 through the fuel nozzle 4. As it enters the oxidant duct 3, the fuel-gas mixture 49 expands, leading to an atomization of the fuel in the combustion air flow 37.

The mechanism of the atomization is shown here by way of example on the basis of only one oxidant duct 3 with only one fuel duct body 42. In the context of the invention, it is self-evidently possible for multiple of these to be provided, wherein then multiple fuel duct sections 43 can advantageously be fed from a common fuel reservoir, for example from one of the ring-shaped supply ducts 13, 14 as per FIGS. 4 to 13A, 13B, and wherein then, analogously thereto, multiple gas duct sections 47 can be fed from a common gas reservoir, for example in the form of ring-shaped grooves or ring-shaped spaces of this type.

By combining the features, and the manifestation thereof, described above on the basis of individual examples, a person skilled in the art will obtain further embodiments of the invention without having to perform an inventive step.

It is understood that the foregoing description is that of the preferred embodiments of the invention and that various changes and modifications may be made thereto without departing from the spirit and scope of the invention as defined in the appended claims.

What is claimed is:

1. A burner defining a burner longitudinal axis, the burner comprising:

a burner head including a base body extending along said burner longitudinal axis;

a central pilot stage disposed in said base body;

a main stage arranged concentrically about said pilot stage;

said main stage being defined by at least one burner stage in said base body;

said at least one burner stage including a plurality of oxidant ducts arranged in said base body concentrically around and at a radial spacing to said burner longitudinal axis;

said plurality of oxidant ducts defining respective duct longitudinal axes;

a plurality of fuel duct bodies, each fuel duct body of the plurality of fuel duct bodies inserted into each one of a respective oxidant duct of said plurality of oxidant ducts so as to extend transversely to the respective duct longitudinal axis corresponding thereto;

each fuel duct body of the plurality of fuel ducts bodies having a nozzle opening provided therein so as to open into the respective oxidant duct of said plurality of oxidant ducts corresponding thereto;

a fuel supply duct arranged in said base body and provided for said at least one burner stage; and, said fuel supply duct running in said base body so as to at least partially encircle said burner longitudinal axis and be adjacent to and communicate with the plurality of fuel duct bodies in the plurality of oxidant ducts.

2. The burner of claim 1, wherein at least one of said nozzle openings is arranged approximately on at least one of the duct longitudinal axes.

3. The burner of claim 1, wherein the plurality of fuel duct bodies are each configured as a jamming body to form a vortex path downstream of said plurality of fuel duct bodies.

4. The burner of claim 3, wherein each said fuel duct body of the plurality of fuel duct bodies is arranged centrally in the respective oxidant duct of the plurality of oxidant ducts corresponding thereto.

5. The burner of claim 4, wherein the plurality of oxidant ducts conduct oxidant in a flow direction and said plurality of fuel duct bodies have symmetrical side surfaces arranged in said flow direction of said plurality of oxidant ducts.

6. The burner of claim 3, wherein each said fuel duct body of the plurality of fuel duct bodies has a cross section along a direction transverse to the respective duct longitudinal axis corresponding thereto selected from the following cross sections: circular, oval, drop-shaped, polygonal, trapezoidal or kite-shaped.

7. The burner of claim 3, wherein each said fuel duct body of the plurality of fuel duct bodies is configured as a jamming body and is disposed along said respective duct longitudinal axis corresponding thereto; and said burner further comprises at least one additional jamming body to form a vortex path downstream of said additional jamming body in at least one oxidant duct of said plurality of oxidant ducts.

8. The burner of claim 7, wherein said at least one additional jamming body is configured without a fuel nozzle.

9. The burner of claim 7, wherein each said fuel duct body of the plurality of fuel duct bodies configured as a jamming body and said additional jamming body have respective mutually different geometries.

10. The burner of claim 1, wherein each said fuel duct body of the plurality of fuel duct bodies has a fuel duct section formed therein for connecting the nozzle to said fuel supply duct for conducting fuel directly from said fuel supply duct to said nozzle.

11. A burner defining a burner longitudinal axis, the burner comprising:

a burner head including a base body extending along said burner longitudinal axis;

a central pilot stage disposed in said base body;

a main stage arranged concentrically about said central pilot stage; said main stage being defined by a first burner stage and a second burner stage in said base body;

said first burner stage and said second burner stage including a first plurality of oxidant ducts and a second plurality of oxidant ducts, respectively, arranged in said base body around and at a radial spacing to said burner longitudinal axis;

said first plurality of oxidant ducts and said second plurality of oxidant ducts defining respective duct longitudinal axes;

a plurality of fuel duct bodies, each fuel duct body of the plurality of fuel duct bodies inserted into each one of a respective oxidant duct of said first plurality of oxidant ducts and said second plurality of oxidant ducts so at to extend transversely to the respective duct longitudinal axis corresponding thereto;

each said fuel duct body of the plurality of fuel duct bodies having a nozzle opening provided therein so as to open into the respective oxidant duct of said first plurality of oxidant ducts and said second plurality of oxidant ducts corresponding thereto;

a first fuel supply duct arranged in said base body for supplying fuel to said first plurality of oxidant ducts via the nozzle opening of each said fuel duct body of the plurality of fuel duct bodies corresponding to said first plurality of oxidant ducts;

a second fuel supply duct independent of said first fuel supply duct;

said second fuel supply duct being arranged in said base body for supplying fuel to said second plurality of oxidant ducts via the nozzle opening of each said fuel duct body of the plurality of fuel duct bodies corresponding to said second plurality of oxidant ducts;

said first fuel supply duct running in said base body so as to at least partially encircle said burner longitudinal axis and be adjacent to and communicate with each said fuel duct body of the plurality of fuel duct bodies corresponding to said first plurality of oxidant ducts; and, said second fuel supply duct running in said base body so as to at least partially encircle said burner longitudinal axis and be adjacent to and communicate with each said fuel duct body of the plurality of fuel duct bodies corresponding to said second plurality of oxidant ducts.

* * * * *